US007252372B2

(12) United States Patent
Kusunoki et al.

(10) Patent No.: US 7,252,372 B2
(45) Date of Patent: Aug. 7, 2007

(54) LIQUID EJECTION APPARATUS AND EJECTION CONTROL METHOD

(75) Inventors: Naoki Kusunoki, Kanagawa (JP); Tetsuzo Kadomatsu, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 330 days.

(21) Appl. No.: 11/072,242

(22) Filed: Mar. 7, 2005

(65) Prior Publication Data

US 2005/0195250 A1 Sep. 8, 2005

(30) Foreign Application Priority Data

Mar. 8, 2004 (JP) ..... 2004-064029

(51) Int. Cl.
*B41J 2/07* (2006.01)

(52) U.S. Cl. ..... 347/74

(58) Field of Classification Search ..... 347/74, 347/76, 77, 78, 80

See application file for complete search history.

(56) References Cited

U.S. PATENT DOCUMENTS

| | | | | |
|---|---|---|---|---|
| 6,450,628 | B1 * | 9/2002 | Jeanmaire et al. | 347/75 |
| 6,485,134 | B2 * | 11/2002 | Dunand | 347/74 |
| 6,511,164 | B1 * | 1/2003 | Bajeux | 347/74 |
| 6,533,379 | B1 | 3/2003 | Kubota et al. | |
| 6,851,796 | B2 * | 2/2005 | Jeanmaire et al. | 347/74 |
| 2003/0231232 | A1 | 12/2003 | Eguchi et al. | |

FOREIGN PATENT DOCUMENTS

| | | | |
|---|---|---|---|
| JP | 2-78558 | A | 3/1990 |
| JP | 6-183129 | A | 7/1994 |
| JP | 6-210856 | A | 8/1994 |
| JP | 11-240158 | A | 9/1999 |
| JP | 2000-177115 | A | 6/2000 |
| JP | 2000-185403 | A | 7/2000 |
| JP | 2002-120361 | A | 4/2002 |
| JP | 2004-58649 | A | 2/2004 |

* cited by examiner

*Primary Examiner*—K. Feggins
(74) *Attorney, Agent, or Firm*—Birch, Stewart, Kolasch & Birch, LLP

(57) ABSTRACT

The liquid ejection apparatus comprises: an ejection head having ejection holes which eject liquid droplets to land on an ejection receiving medium; a conveyance device which causes the ejection head and the ejection receiving medium to move relative to each other in one direction, by conveying at least one of the ejection head and the ejection receiving medium in a relative conveyance direction substantially perpendicular to a breadthways direction of the ejection receiving medium; a direction of flight deflecting device which deflects direction of flight of the liquid droplets ejected from the ejection head in a direction which includes at least a component that is substantially parallel to the relative conveyance direction; and a deflection control device which controls the direction of flight deflecting device, wherein when droplets are ejected during relative conveyance of the ejection receiving medium and a row of dots is formed in which dots that are mutually adjacent in the relative conveyance direction are at least partially overlapping with each other, the deflection control device changes landing positions of the liquid droplets by a droplet landing position change amount y which satisfies the following relationship: y=Pts×I, where Pts is a pitch between dots in the row of dots in the relative conveyance direction, I is an amount of shift comprising two or more types of integers of any value, and y is the droplet landing position change amount in the relative conveyance direction, thereby causing the droplets to land while avoiding consecutive landing of mutually adjacent dots.

9 Claims, 18 Drawing Sheets

LIQUID EJECTION APPARATUS AND EJECTION CONTROL METHOD

BACKGROUND OF THE INVENTION

1. Field of the Invention

The present invention relates to a liquid ejection apparatus and an ejection control method, and more particularly, to an ejection control technology for a liquid ejection apparatus which forms shapes such as images or prescribed patterns on an ejection receiving medium, by ejecting liquid droplets from ejection holes.

2. Description of the Related Art

In recent years, inkjet printers have come to be used widely as data output apparatuses for outputting images, documents, or the like. By driving recording elements, such as nozzles, provided in a recording head in accordance with data, an inkjet printer is able to form data onto a recording medium, such as recording paper, by means of ink ejected from the nozzles.

In an inkjet printer, a desired image is formed on a recording medium by causing a recording head having a plurality of nozzles and a recording medium to move relative to each other, while causing ink droplets to be ejected from the nozzles.

Until now, inkjet printers have been using as apparatuses for outputting documents principally in domestic and office scenarios, but recently, they have started to be used for outputting images captured by digital cameras, and the like. Furthermore, there are also inkjet apparatuses which are compatible with A3 and poster size recording media, and hence they have come to be used for outputting publicity prints, posters, or the like.

Good image resolution is an important requirement in image printing, and high-quality image printing is achieved by developments such as multi-color printing, multiple tone graduation, finer dot size, higher dot density, and the like. For example, by using multiple ink colors, such as light color inks, it is possible to achieve full color and multiple-stage tone graduation. By increasing the density of the nozzle arrangement and reducing the droplet size, it is possible to increase dot density and reduce dot size in the image. Moreover, if droplet ejection control is performed in order that ink is ejected in such a manner that adjacent dots are mutually overlapping, then the dots can be formed to a high density on the recording medium.

However, when adjacent dots are formed in an overlapping fashion, if the subsequent ink droplet is deposited before the previously deposited ink has become fixed in the recording medium, then the shape of the respective dots is disrupted, the subsequently deposited ink droplet moves towards the previously deposited ink droplet, and streaking or non-uniformity may occur in the resulting image. Furthermore, if inks of different colors are deposited in an overlapping fashion, then color mixing occurs, and it becomes impossible to achieve the desired colors and tone graduation.

In general, various methods are used in order to prevent deposition interference between dots of this kind. For example, droplet ejection control is implemented in order that a subsequent ink droplet is ejected after waiting for a previously deposited ink droplet to permeate to a certain degree into the medium. Alternatively, a temperature adjusting device is provided which warms the recording medium onto which ink has been deposited and the ink that has been deposited on the recording medium, and the fixing of the ink is accelerated by using of this temperature adjusting device.

In a further method, an ultraviolet curable ink is used to form the image, and fixing of the ink deposited on the recording medium is accelerated by irradiating ultraviolet light onto the ejected ink.

Japanese Patent Application Publication No. 6-183129 discloses an inkjet recording method and an inkjet recording apparatus using this method, in which recording is performed by moving a plurality of recording heads disposed in a parallel arrangement with respect to a recording medium, the method being composed in such a manner that recording timings are staggered between recording of either one of the ink dots contacting a border between ink dots of different inks, and recording of other ink dots.

Japanese Patent Application Publication No. 2002-120361 discloses an inkjet recording apparatus comprising a drum for fixing paper in position and a plurality of inkjet heads disposed facing the drum at prescribed intervals apart in the circumferential direction of the drum, color printing being performed onto the paper by driving the inkjet heads while rotating the drum. The inkjet recording apparatus is composed in such a manner that time T until dots of different colors make contact or overlap mutually at their deposition point on the paper is $T \geqq 10$ msec.

Japanese Patent Application Publication No. 2000-177115 discloses a printing method and a print head apparatus using this method, in which an electrostatically charged ink is used, and a channel for ejecting ink is provided between electrodes which generate an electrical field. The electrical field acts on the ink ejected from the channel and thus deflects the direction of ejection of the ink.

Japanese Patent Application Publication No. 2000-185403 discloses an inkjet nozzle, inkjet recording head, inkjet cartridge and inkjet recording apparatus, in which a plurality of heaters that generate air bubbles in the ink are provided at the nozzles. By controlling the heaters, different types of bubbles are generated in the ink and hence the direction of flight of the ink can be deflected.

However, if a subsequent ink droplet is ejected after waiting until a previously deposited ink droplet has permeated to a certain degree, then it is necessary to provide a time differential between the landing times of adjacently positioned dots, and this places a restriction on high-speed printing. Furthermore, if fixing of the ink is accelerated by means of heat or ultraviolet light, then it is necessary to provide a temperature adjustment device or ultraviolet light source, in addition to which, the type of ink and the type of media that can be used may be limited.

In the inkjet recording method and the inkjet recording apparatus using same described in Japanese Patent Application Publication No. 6-183129, and the inkjet recording apparatus described in Japanese Patent Application Publication No. 2002-120361, high image quality is achieved by preventing bleeding or reduced concentration through specifying the deposition timings between inks of different colors, but neither the issue of deposition interference between ink droplets of the same color, nor the issue of high-speed printing, are resolved.

Furthermore, in the printing method and the print head device using same described in Japanese Patent Application Publication No. 2000-177115, and the inkjet nozzle, inkjet recording head, inkjet cartridge, and inkjet recording apparatus described in Japanese Patent Application Publication No. 2000-185403, a method is disclosed which prevents image degradation such as non-uniformity, by deflecting the direction of flight of the ejected ink droplets, but no disclosure is provided with regard to a control method for preventing deposition interference or issues relating to same.

SUMMARY OF THE INVENTION

The present invention has been contrived in view of such circumstances, and an object thereof is to provide a liquid ejection device and droplet ejection control method whereby deposition interference between dots formed so as to be mutually overlapping is prevented, thereby obtaining satisfactory dots, in addition to which, high-speed droplet ejection can be achieved.

In order to attain the aforementioned object, the present invention is directed to a liquid ejection apparatus, comprising: an ejection head having ejection holes which eject liquid droplets to land on an ejection receiving medium; a conveyance device which causes the ejection head and the ejection receiving medium to move relative to each other in one direction, by conveying at least one of the ejection head and the ejection receiving medium in a relative conveyance direction substantially perpendicular to a breadthways direction of the ejection receiving medium; a direction of flight deflecting device which deflects direction of flight of the liquid droplets ejected from the ejection head in a direction which includes at least a component that is substantially parallel to the relative conveyance direction; and a deflection control device which controls the direction of flight deflecting device, wherein when droplets are ejected during relative conveyance of the ejection receiving medium and a row of dots is formed in which dots that are mutually adjacent in the relative conveyance direction are at least partially overlapping with each other, the deflection control device changes landing positions of the liquid droplets by a droplet landing position change amount y which satisfies the following relationship: $y=Pts\times I$, where Pts is a pitch between dots in the row of dots in the relative conveyance direction, I is an amount of shift comprising two or more types of integers of any value, and y is the droplet landing position change amount in the relative conveyance direction, thereby causing the droplets to land while avoiding consecutive landing of mutually adjacent dots.

According to the present invention, when forming dot rows in the relative conveyance direction of the ejection receiving medium, the direction of flight of ink droplets ejected from the ejection head is deflected in a direction including at the least a component that is substantially parallel to the relative conveyance direction, thereby changing the landing positions of the ink droplets through a prescribed landing position change amount y in the relative conveyance direction, and hence causing the ink droplets to land in dispersed positions. Therefore, ink droplets that are ejected consecutively land at positions separated by a dot center-to-dot center distance of $I\times Pts$ which is equivalent to I dots, and therefore no deposition interference occurs and droplets can be ejected sequentially without waiting for the deposited ink droplets to permeate into the medium. Two or more types of integers of any value are used for the shift amount I.

If a full line type ejection head having a plurality of ejection holes arranged through the entire width of the ejection receiving medium is used as the ejection head, then a row of dots formed in the relative conveyance direction is formed by means of ink droplets ejected from one nozzle. Furthermore, a mode where two dots which are mutually adjacent in the relative conveyance direction of ejection receiving medium are formed so as to be mutually overlapping also includes a mode where the two dots lie in contact with each other.

If a full line type ejection head is used, then it is possible to eject ink droplets over the whole receivable region of the ejection receiving medium, by means of single-pass control which causes the ejection receiving medium to be scanned once only.

The direction of flight of an ink droplet after deflection includes a component of the original direction of flight of the ink droplet (namely, a perpendicular direction with respect to the ejection receiving surface of the ejection receiving medium, which is substantially perpendicular to the surface of the ejection head that faces the ejection receiving medium). Moreover, the component of the deflected direction of flight of the ink droplet that is substantially parallel to the relative conveyance direction may include a positive direction (for example, the direction of travel of the ejection receiving medium if the ejection receiving medium moves with respect to a fixed ejection head) and a negative direction (the direction opposite to the positive direction).

The positive direction and the negative direction may be switched in alternating fashion, or they may be switched after every certain number of cycles.

The amount of shift I including two or more types of integers of any value may include positive integers and negative integers. The amount of shift I indicates that a deflected ink droplet lands at a position that is shifted by a distance equivalent to I dots in the relative conveyance direction, from the original landing position of the droplet if its direction of flight were not to be deflected. The amount of shift I may be zero.

Taking the angle formed between the original direction of flight of an ink droplet (a direction substantially perpendicular to the ejection receiving surface of the ejection receiving medium) and the direction of flight of the ink droplet after deflection (namely, the deflection angle) to be $\theta$, the landing position change amount of the ink droplet to be y, and the clearance between the ejection head and the ejection receiving medium to be z, then the deflection angle $\theta$ is expressed by $\theta=\arctan(y/z)$.

Moreover, "ejection receiving medium" indicates a medium onto which ink droplets are ejected from an ejection head, and more specifically, this term includes various types of media, irrespective of material and size, such as continuous paper, cut paper, sealed paper or other types of paper, resin sheets, such as OHP sheets, film, cloth, and other materials. The ejection receiving medium may also be called an image forming medium, print medium, image receiving medium, or the like.

Preferably, the amount of shift I includes at least two types of integers whereby $\Delta y$ which is the distance between centers of the landing positions of consecutively ejected ink droplets, satisfies the following relationship: $\Delta y \geqq 2\times Pts$ .

By setting a shift amount of this kind, it is possible to control droplet ejection in such a manner that dots ejected consecutively do not overlap with each other, when recording with a level of dot overlap that satisfies the relationship $D/2 \leqq Pts$ between the dot diameter D and the interval between dots (the dot center-to-dot center distance) Pts.

For example, the shift amount I includes three or more types of integers.

Desirably, the three or more types of integers include positive and negative integers.

For example, the amount of shift I includes two or more natural numbers, k, of one type which satisfy the following relationship: $I=\pm k$ .

More specifically, by taking the amount of shift I to be positive and negative integers including one natural number, it is possible to simplify the droplet ejection sequence (namely, the deflection sequence and the droplet ejection position setting sequence).

Preferably, the direction of flight control device includes a shift amount setting device which sets the natural number k to a value whereby a droplet ejection cycle of the ejection head, Tf, and a permeation time of the liquid droplet into the ejection receiving medium, T0, satisfy the following relationship: $Tf\times(2k-1)\geqq T0$.

In other words, a direction of flight deflection pattern can be established which prevents deposition interference with respect to various parameters, such as the dot density, the relative conveyance speed of the ejection receiving medium, and permeation time of the liquid droplets into the ejection receiving medium. More specifically, it is possible to establish an amount of deflection parameter, k, whereby the difference between the landing times of dots which are mutually adjacent on the ejection receiving medium in the relative conveyance direction of the recording medium, is greater than the permeation time of the previously deposited dot.

Preferably, the liquid ejection apparatus further comprises a droplet ejection control device which, taking D1 and D2 to be diameters of two dots which share an adjacent dot in the relative conveyance direction, in a row of dots formed in the relative conveyance direction, and taking Pts to be a pitch between dots in the relative conveyance direction, sets at least one of the dot diameter D1, the dot diameter D2, and the pitch Pts between dots in the relative conveyance direction, in such a manner that the following relationship is satisfied: $D1+D2\leqq 2\times Pts$.

More specifically, provided that the total of the diameters of two dots that are ejected consecutively is equal to or less than twice the dot-to-dot pitch Pt in the relative conveyance direction of the recording medium, then there will be no overlap between alternately positioned dots, and hence these dots can be ejected in a consecutive fashion. By performing droplet ejection control in this way, the dot sizes (dot diameters) of mutually adjacent dots can be selected freely, and hence tonal graduation can be improved.

For example, the ejection head includes a full line type ejection head in which the ejection holes are arranged through an entire width of the ejection receiving medium.

A full line ejection head may be formed to a length corresponding to the full width of the recording medium by combining short head having rows of ejection holes which do not reach a length corresponding to the full width of the ejection receiving medium, these short heads being joined together in a staggered matrix fashion.

Preferably, the ejection head includes a matrix head in which the ejection holes are two-dimensionally arranged; and the ejection holes which eject liquid droplets forming dots that are mutually adjacent in a direction substantially perpendicular to the relative conveyance direction are positioned at a prescribed distance apart in the relative conveyance direction.

More specifically, it is possible to make effective use of a nozzle arrangement pattern in which nozzles are arranged in a two-dimensional configuration suitable for high-density droplet ejection.

The two-dimensionally arranged ejection holes include a plurality of ejection hole rows aligned in a direction which forms a certain angle with respect to the relative conveyance direction.

Moreover, in order to attain the aforementioned object, the present invention is also directed to an ejection control method for a liquid ejection apparatus, comprising: an ejection head having ejection holes which eject liquid droplets to land on an ejection receiving medium; a conveyance device which causes the ejection head and the ejection receiving medium to move relative to each other in one direction, by conveying at least one of the ejection head and the ejection receiving medium in a relative conveyance direction substantially perpendicular to a breadthways direction of the ejection receiving medium; and a direction of flight deflecting device which deflects a direction of flight of the liquid droplets ejected from the ejection head, the ejection control method comprising the steps of: deflecting direction of flight of liquid droplets ejected from the ejection holes of the ejection head in a direction which includes at least a component that is substantially parallel to the relative conveyance direction, by means of the liquid droplet flight direction deflecting device, when forming a row of dots in the relative conveyance direction, and thereby changing landing positions of the liquid droplets by a droplet landing position change amount y which satisfies the following relationship: $y=Pts\times I$, where Pts is a pitch between dots in the row of dots in the relative conveyance direction, I is an amount of shift comprising two or more types of integers of any value, and y is the droplet landing position change amount in the relative conveyance direction; and causing the droplets to land while avoiding consecutive landing of mutually adjacent dots.

More specifically, satisfactory droplet ejection is performed, which achieves high-speed droplet ejection while preventing the occurrence of deposition interference, without changing the relationship between the ejection receiving medium and the ejection head. On the other hand, if the relative conveyance speed of the ejection receiving medium and the ejection cycle of the droplets changes, then the conditions of the droplet landing position change amount are changed accordingly.

According to the present invention, in droplet ejection performed consecutively in the relatively conveyance direction, the direction of flight of ink droplets is deflected in a direction including a component that is substantially parallel to the relative conveyance direction, thereby shifting the landing positions of the droplets from their original landing positions, by an integral factor of the dot-to-dot pitch of a dot row formed in the relative conveyance direction. Therefore, mutually adjacent dots are not formed by consecutive ejection operations, and it is possible to prevent deposition interference.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
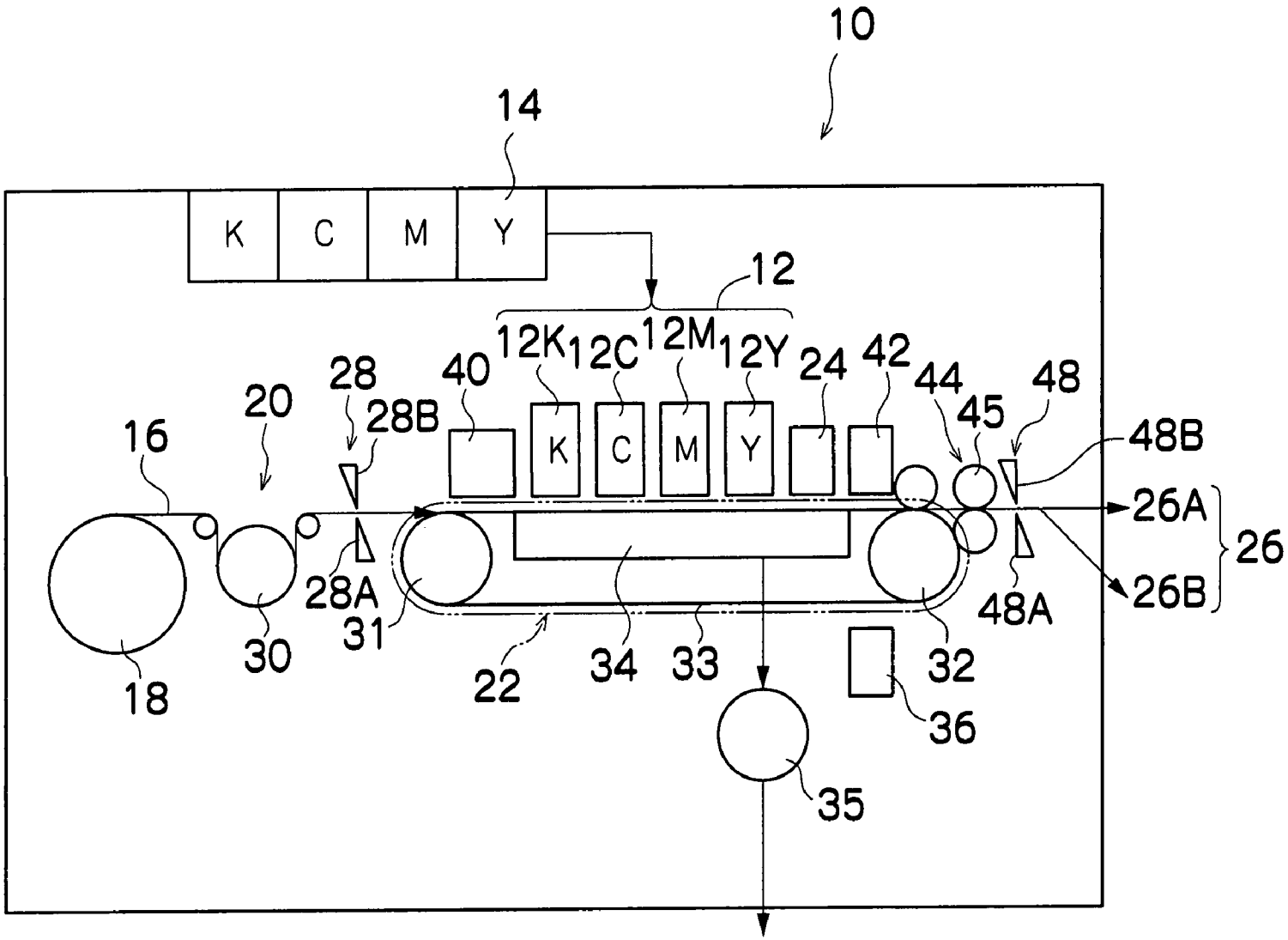
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (not shown in FIG. 1, but shown in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
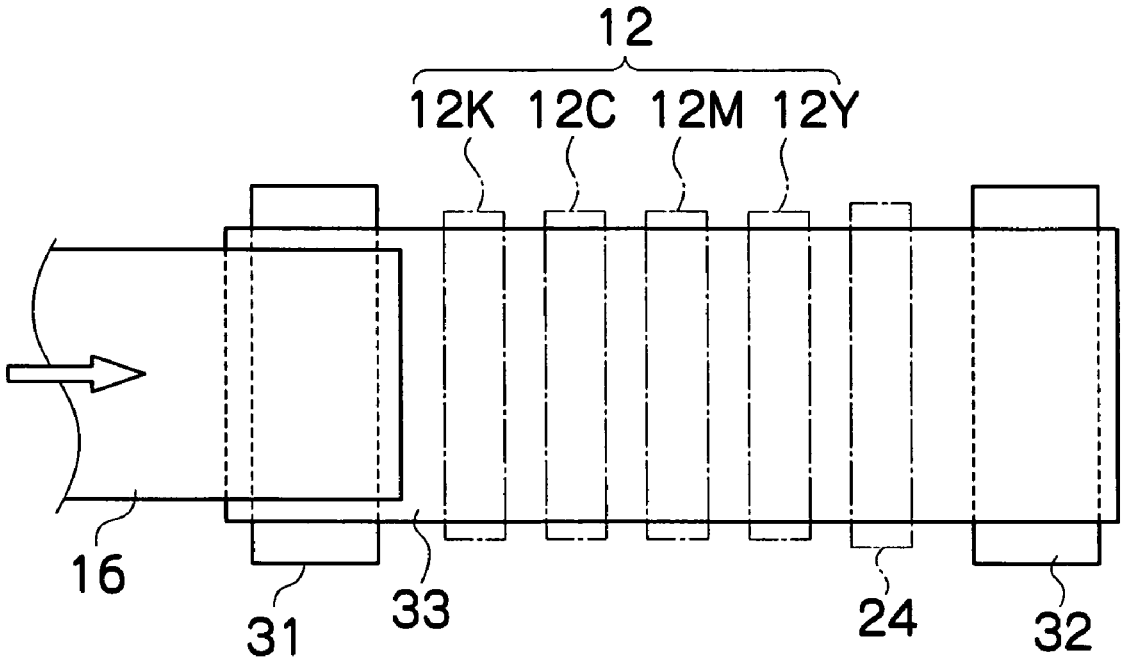
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later with reference to FIGS. 3A to 5. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

The printing unit 12, in which the full-line heads covering the entire width of the paper are thus provided for the respective ink colors, can record an image over the entire surface of the recording paper 16 by performing the action of moving the recording paper 16 and the printing unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

As shown in FIG. 1, the ink storing and loading unit 14 has tanks for storing the inks of K, C, M and Y to be supplied to the print heads 12K, 12C, 12M, and 12Y, and the tanks are connected to the print heads 12K, 12C, 12M, and 12Y through channels (not shown), respectively. The ink storing and loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position.

The post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B. Although not shown in FIG. 1, the paper output unit 26A for the target prints is provided with a sorter for collecting prints according to print orders.

Next, the structure of the print heads is described. The print heads 12K, 12C, 12M and 12Y have the same structure, and a reference numeral 50 is hereinafter designated to any of the print heads 12K, 12C, 12M and 12Y.

In the present embodiment, a paper medium is described as the ejection receiving medium onto which ink droplets are ejected by the inkjet recording apparatus 10. However, besides a paper medium, it is also possible to use various other types of ejection receiving media, such as a metallic plate, resin plate, wood, cloth, leather, or the like, which is capable of fixing ink therein, and which can be conveyed relatively to the print head 50, and maintain a clearance with respect to the print head 50.

Figure 3A:
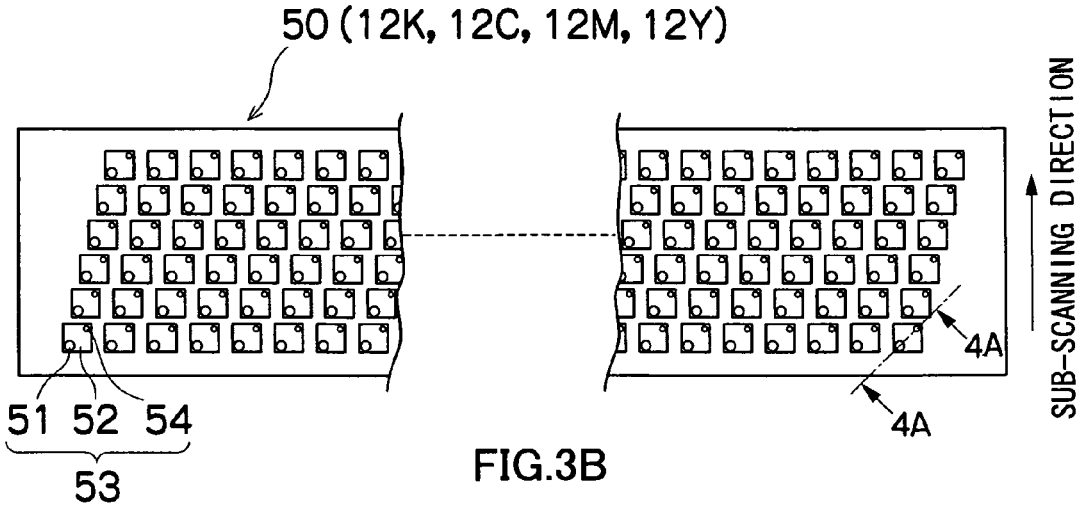
FIG. 3A is a perspective plan view showing an example of a configuration of a print head.
Figure 3B:
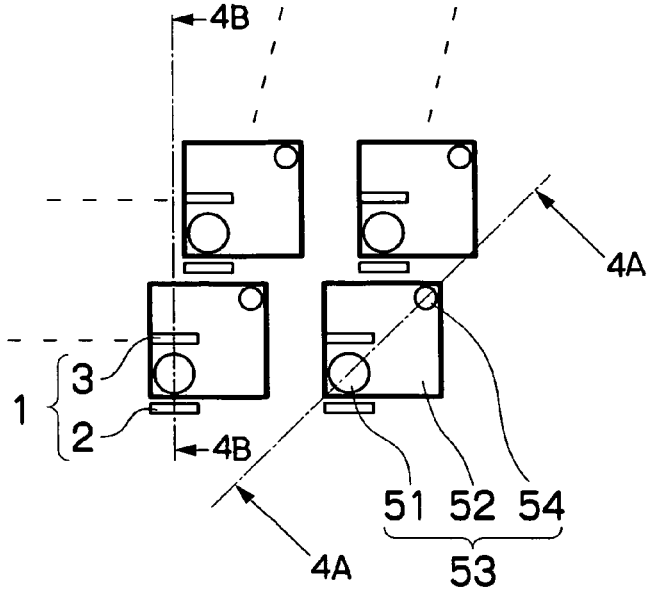
FIG. 3B is a partial enlarged view of FIG. 3A.
Figure 3C:
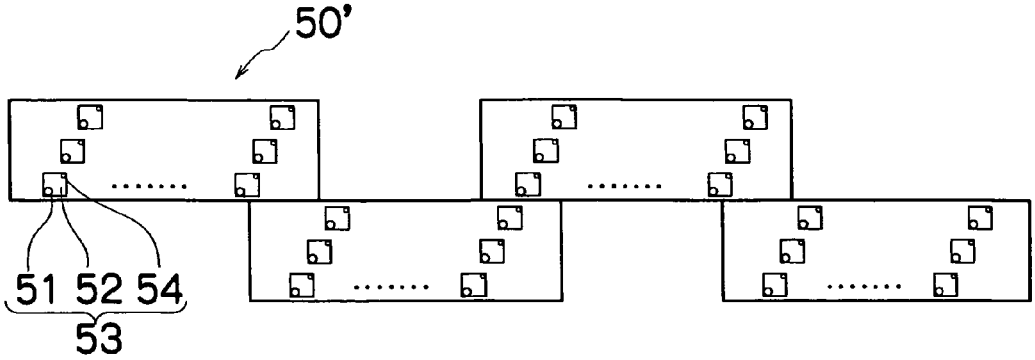
FIG. 3C is a perspective plan view showing another example of the configuration of the print head.
Figure 4A:
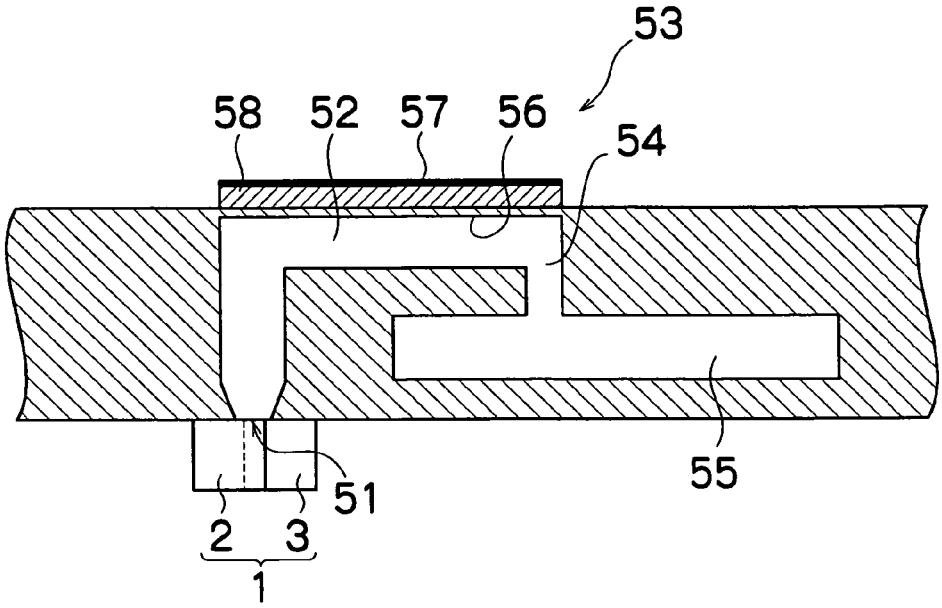
FIG. 4A is a cross-sectional view along a line 4A-4A in FIGS. 3A and 3B.
Figure 4B:
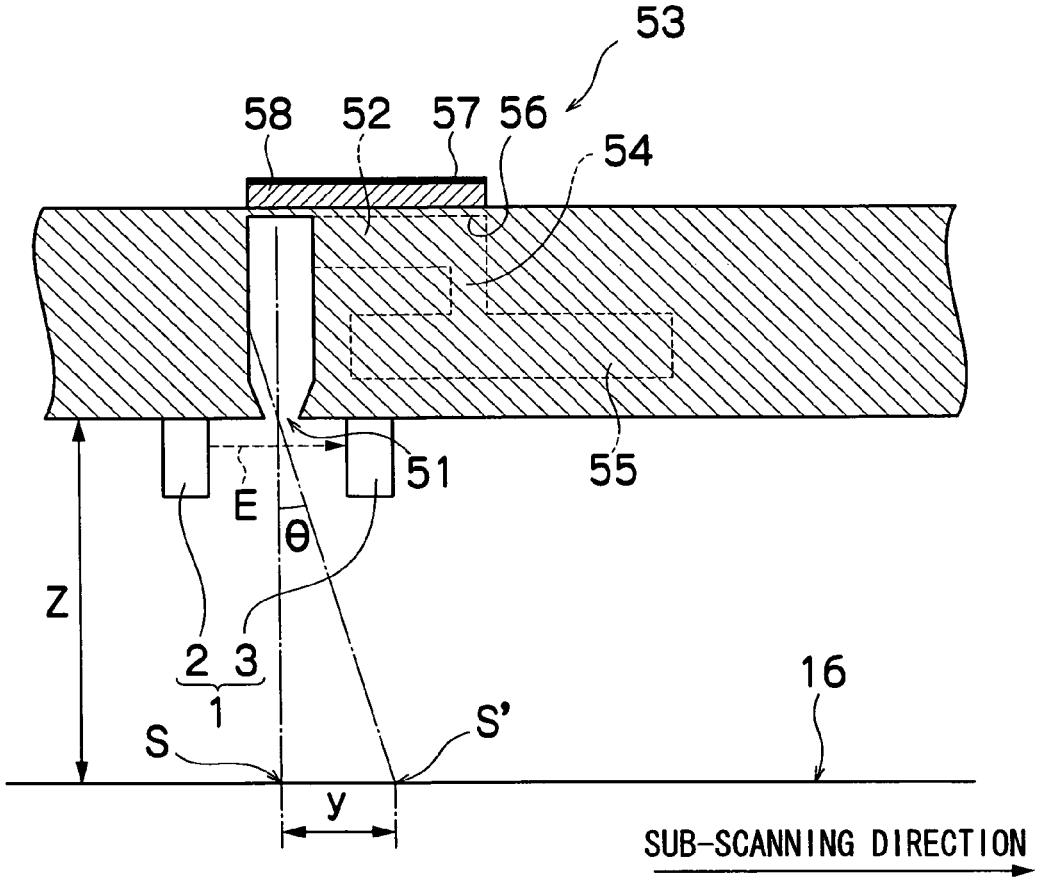
FIG. 4B is a cross-sectional view along a line 4B-4B in FIG. 3B.

FIG. 3A is a perspective plan view showing an example of the configuration of the print head 50, FIG. 3B is an enlarged view of a portion thereof, and FIG. 3C is a perspective plan view showing another example of the configuration of the print head. FIGS. 4A and 4B are cross-sectional views showing the inner structure of an ink chamber unit. FIG. 4A is a cross-sectional view taken along the line 4A-4A in FIGS. 3A and 3B, and FIG. 4B is a cross-sectional view taken along the line 4B-4B in FIG. 3B.

The nozzle pitch in the print head 50 should be minimized in order to maximize the density of the dots printed on the surface of the recording paper. As shown in FIGS. 3A to 4B, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

Thus, as shown in FIGS. 3A and 3B, the print head 50 in the present embodiment is a full-line head in which one or more of nozzle rows in which the ink ejecting nozzles 51 are arranged along a length corresponding to the entire width of the recording medium in the direction substantially perpendicular to the conveyance direction of the recording medium.

Alternatively, as shown in FIG. 3C, a full-line head can be composed of a plurality of short two-dimensionally arrayed head units 50' arranged in the form of a staggered matrix and combined so as to form nozzle rows having lengths that correspond to the entire width of the recording paper 16.

Furthermore, in each nozzle, a flight direction deflecting device 1 is provided which deflects the direction of flight of ink droplets ejected from the nozzle 51 in a direction substantially parallel to the conveyance direction of the recording paper. The flight direction deflecting device 1 comprises a pair of electrodes 2 and 3 arranged in a direction substantially parallel to the conveyance direction of the recording paper, in such a manner that they face the nozzle 51 on either side thereof.

The planar shape of the pressure chamber 52 provided for each nozzle 51 is substantially a square, and the nozzle 51 and an inlet of supplied ink (supply port) 54 are disposed in both corners on a diagonal line of the square. Each pressure chamber 52 is connected to a common channel 55 through the supply port 54.

An actuator 58 having an individual electrode 57 is joined to a pressure plate 56, which forms the ceiling of the pressure chamber 52, and the actuator 59 is deformed by applying drive voltage to the individual electrode 57 to eject ink from the nozzle 51. When ink is ejected, new ink is delivered from the common flow channel 55 through the supply port 54 to the pressure chamber 52.

If an electrical field E (indicated by dashed lines) is generated between the electrode 2 and the electrode 3 shown in FIGS. 4A and 4B, then the electrical field E acts on the ink droplet ejected from the nozzle 51 and deflects the direction of flight of the ink droplet through an angle of θ from its original direction of flight. As shown in FIG. 4B, the direction of the electrical field E is from the electrode 2 toward the electrode 3 (in other words, a direction substantially parallel to the conveyance direction of the paper).

If the electrical field E acts on an ink droplet ejected from the nozzle 51, then the direction of flight of the ink droplet is deflected through an angle of θ toward the conveyance direction of the recording paper, from the original direction of flight of the ink droplet. The landing position of the ink droplet whose direction of flight has been deflected is moved from the original landing position s, to a position s' shifted by a distance of y from the position s in a direction substantially parallel to the conveyance direction of the recording paper.

More specifically, the relationship between the distance z from the nozzle surface of the print head 50 to the recording paper 16, the angle (flight deflection angle) θ formed between the original direction of flight of the ink and the direction of flight of the ink after deflection, and the amount of change in the landing position, y, is expressed by the following equation (1):

$$y = z \times \tan\theta. \quad (1)$$

Figure 5:
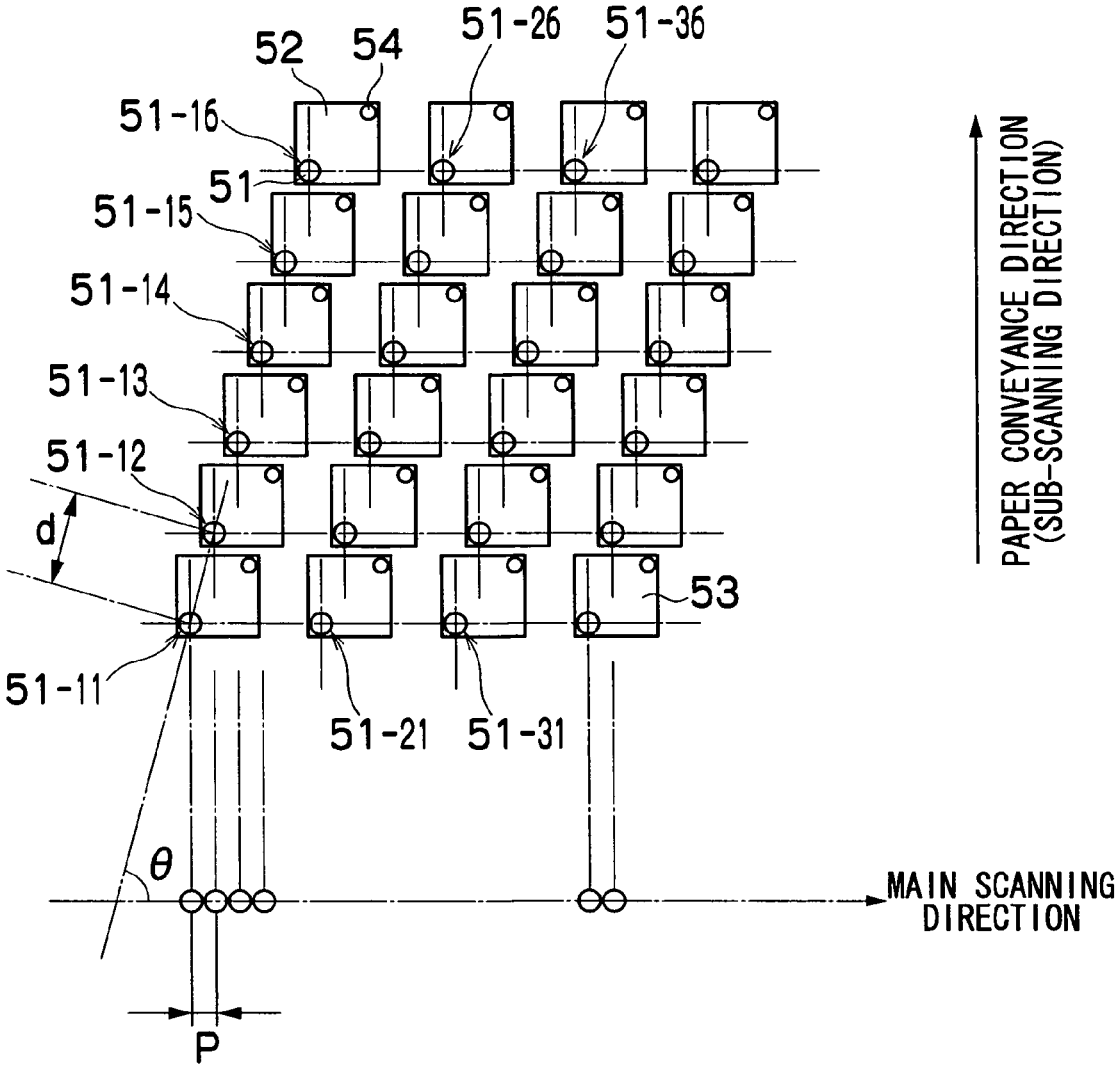
FIG. 5 is an enlarged view showing nozzle arrangement of the print head in FIG. 3A.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch P as projected in the main scanning direction is d×cos θ.

Hence, the nozzles 51 can be regarded to be equivalent to those arranged at a fixed pitch P on a straight line along the main scanning direction. Such configuration results in a nozzle structure in which the nozzle row projected in the main scanning direction has a high nozzle density of up to 2,400 nozzles per inch (npi).

In a full-line head comprising rows of nozzles that have a length corresponding to the entire width of the paper (the recording paper 16), the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

In implementing the present invention, the arrangement of the nozzles is not limited to that of the example illustrated. Moreover, a method is employed in the present embodiment where an ink droplet is ejected by means of the deformation of the actuator 59, which is typically a piezoelectric element; however, in implementing the present invention, the method used for ejecting ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure of these bubbles.

Figure 6:
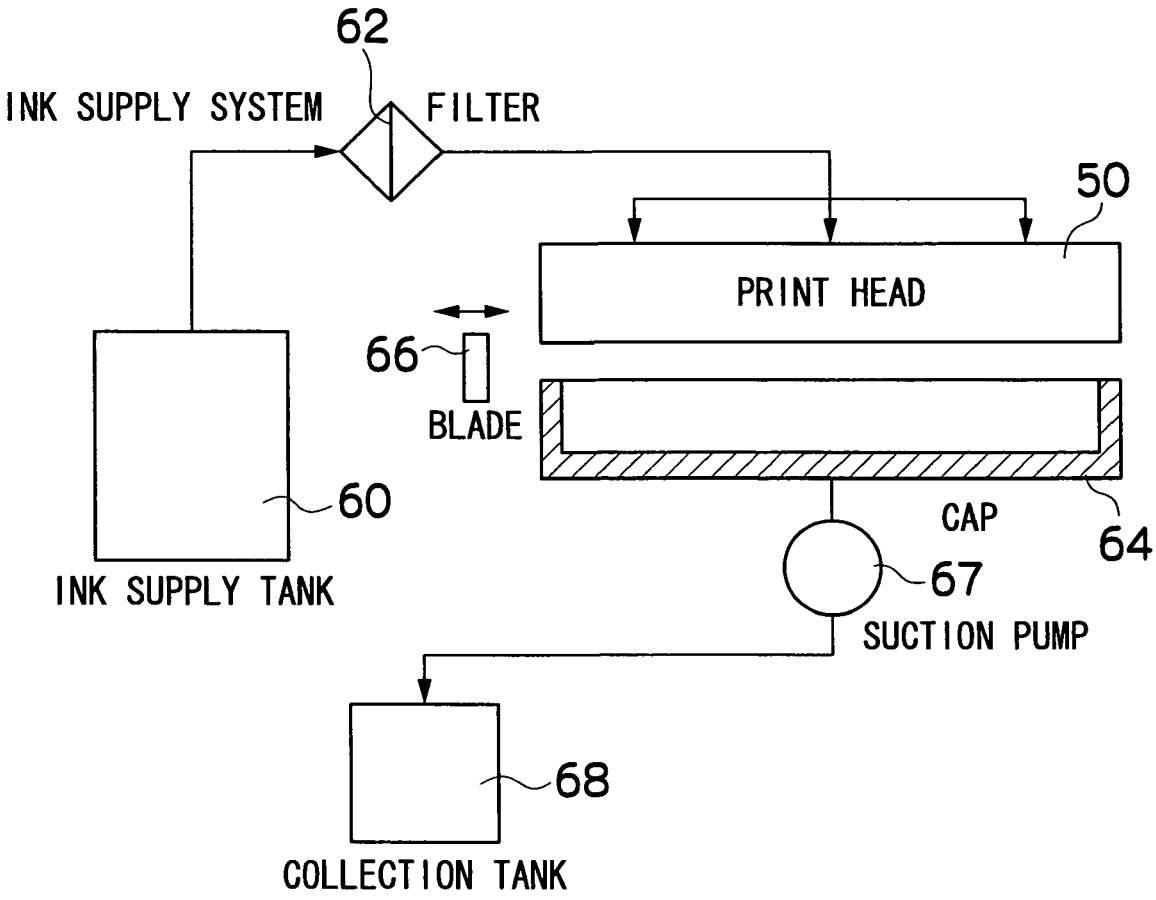
FIG. 6 is a schematic drawing showing a configuration of an ink supply system in the inkjet recording apparatus.

FIG. 6 is a schematic drawing showing the configuration of the ink supply system in the inkjet recording apparatus 10. An ink supply tank 60 is a base tank that supplies ink and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing and loading unit 14 in FIG. 1 described above.

A filter 62 for removing foreign matters and bubbles is disposed between the ink supply tank 60 and the print head 50 as shown in FIG. 6. The filter mesh size in the filter 62 is preferably equivalent to or less than the diameter of the nozzle and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face. A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face is thereby covered with the cap 64.

The cleaning blade 66 is composed of rubber or another elastic member, and can slide on the ink ejection surface (surface of the nozzle plate) of the print head 50 by means of a blade movement mechanism (not shown). When ink droplets or foreign matter has adhered to the nozzle plate, the surface of the nozzle plate is wiped, and the surface of the nozzle plate is cleaned by sliding the cleaning blade 66 on the nozzle plate.

During printing or standby, when the frequency of use of specific nozzles is reduced and ink viscosity increases in the vicinity of the nozzles, a preliminary ejection is made toward the cap 64 to eject the degraded ink.

Also, when bubbles have become intermixed in the ink inside the print head 50 (inside the pressure chamber), the cap 64 is placed on the print head 50, ink (ink in which bubbles have become intermixed) inside the pressure chamber is removed by suction with a suction pump 67, and the suction-removed ink is sent to a collection tank 68. This suction action entails the suctioning of degraded ink whose viscosity has increased (hardened) when initially loaded into the head, or when service has started after a long period of being stopped.

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the actuator 59 is operated. Before reaching such a state the actuator 59 is operated (in a viscosity range that allows ejection by the operation of the actuator 59), and the preliminary ejection is made toward the ink receptor to which the ink whose viscosity has increased in the vicinity of the nozzle is to be ejected. After the nozzle surface is cleaned by a wiper such as the cleaning blade 66 provided as the cleaning device for the nozzle face, a preliminary ejection is also carried out in order to prevent the foreign matter from becoming mixed inside the nozzles 51 by the wiper sliding operation. The preliminary ejection is also referred to as "dummy ejection", "purge", "liquid ejection", and so on.

When bubbles have become intermixed in the nozzle 51 or the pressure chamber 52, or when the ink viscosity inside the nozzle 51 has increased over a certain level, ink can no longer be ejected by the preliminary ejection, and a suctioning action is carried out as follows.

More specifically, when bubbles have become intermixed in the ink inside the nozzle 51 and the pressure chamber 52, ink can no longer be ejected from the nozzles even if the actuator 59 is operated. Also, when the ink viscosity inside the nozzle 51 has increased over a certain level, ink can no longer be ejected from the nozzle 51 even if the actuator 59 is operated. In these cases, a suctioning device to remove the ink inside the pressure chamber 52 by suction with a suction pump, or the like, is placed on the nozzle face of the print head 50, and the ink in which bubbles have become intermixed or the ink whose viscosity has increased is removed by suction.

However, this suction action is performed with respect to all the ink in the pressure chamber 52, so that the amount of ink consumption is considerable. Therefore, a preferred aspect is one in which a preliminary ejection is performed when the increase in the viscosity of the ink is small.

The cap 64 described with reference to FIG. 6 serves as the suctioning device and also as the ink receptacle for the preliminary ejection.

Figure 7:
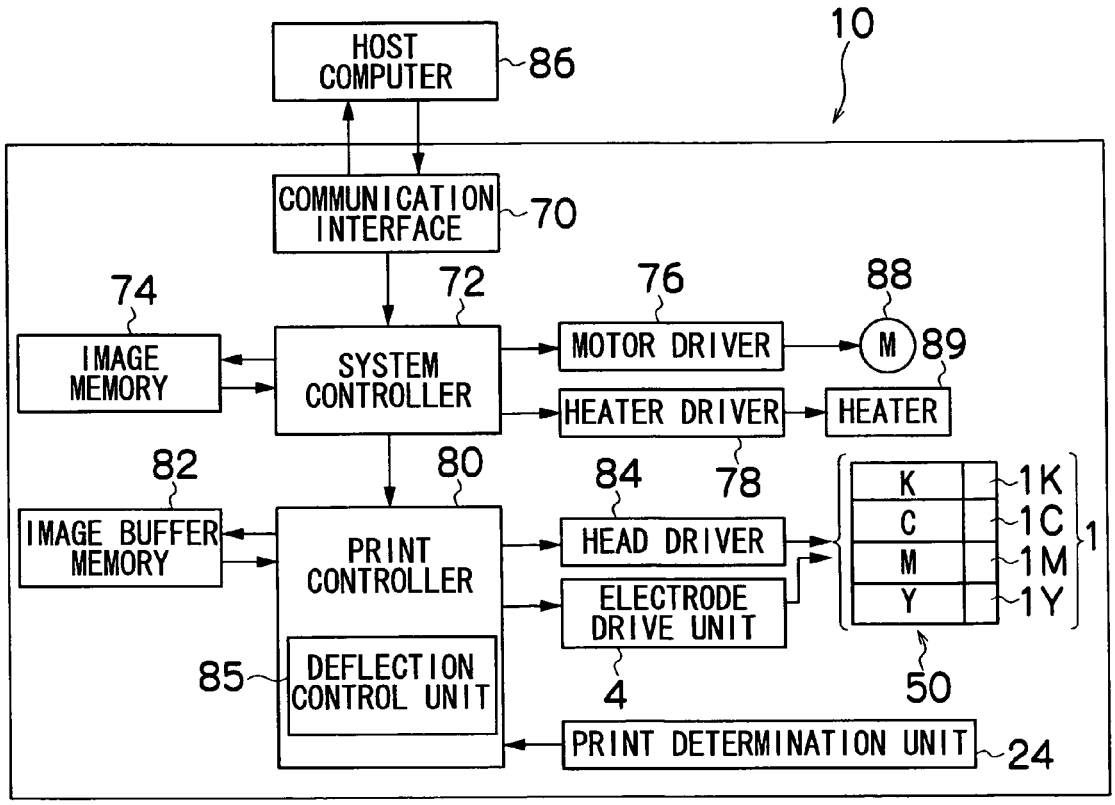
FIG. 7 is a principal block diagram showing the system composition of the inkjet recording apparatus.

FIG. 7 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print control unit 80 is a control unit having a signal processing function for performing various treatment processes, corrections, and the like, in accordance with the control implemented by the system controller 72, in order to generate a signal for controlling printing, from the image data in the image memory 74, and it supplies the print control signal (image data) thus generated to the head driver 84. Prescribed signal processing is carried out in the print control unit 80, and the ejection amount and the ejection timing of the ink droplets from the respective print heads 50 are controlled via the head drier 84, on the basis of the image data. By this means, prescribed dot sizes and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

Furthermore, a deflection control unit 85 inside the print controller 80 controls the driving of the electrodes 2 and 3 provided at each nozzle, by means of an electrode drive unit 4. In other words, if the direction of flight of an ink droplet ejected from a nozzle is to be deflected on the basis of the print data, then an electrical field is generated between the corresponding electrodes 2 and 3 by supplying a command signal to the electrode drive unit 4.

The head driver 84 drives the actuators 59 for the print heads 12K, 12C, 12M and 12Y of the respective colors on the basis of the print data received from the print controller 80. A feedback control system for keeping the drive conditions for the print heads constant may be included in the head driver 84.

Various control programs are stored in a program storage section (not illustrated), and a control program is read out and executed in accordance with commands from the system controller 72. The program storage section may use a semiconductor memory, such as a ROM, EEPROM, or a magnetic disk, or the like. An external interface may be provided, and a memory card or PC card may also be used. Naturally, a plurality of these storage media may also be provided.

The program storage section may also be combined with a storage device for storing operational parameters, and the like (not illustrated).

The print determination unit 24 is a block that includes the line sensor as described above with reference to FIG. 1, reads the image printed on the recording paper 16, determines the print conditions (presence of the ejection, variation in the dot deposition, and the like) by performing desired signal processing, or the like, and provides the determination results of the print conditions to the print controller 80. The read start timing for the line sensor is determined from the distance between the line sensor and the nozzles and the conveyance velocity of the recording paper 16.

The print controller 80 makes various compensation with respect to the print head 50 as required on the basis of the information obtained from the print determination unit 24.

In the example shown in FIG. 1, the print determination unit 24 is provided on the print surface side, the print surface is irradiated with a light source (not illustrated), such as a cold cathode fluorescent tube disposed in the vicinity of the line sensor, and the reflected light is read in by the line sensor. However, in implementing the present invention, another composition may be adopted.

Droplet Ejection Control

Next, droplet ejection control in the inkjet recording apparatus 10 will be described.

In this inkjet recording apparatus 10, droplet ejection control is implemented to prevent the occurrence of dot shape abnormalities caused by deposition interference, even if adjacent dots are formed so as to be mutually overlapping by means of ink droplets ejected continuously from the same ejection hole (nozzle 51).

Firstly, a dot formed on recording paper 16 by means of an ink droplet ejected from a print head 50 will be described.

Figure 8:
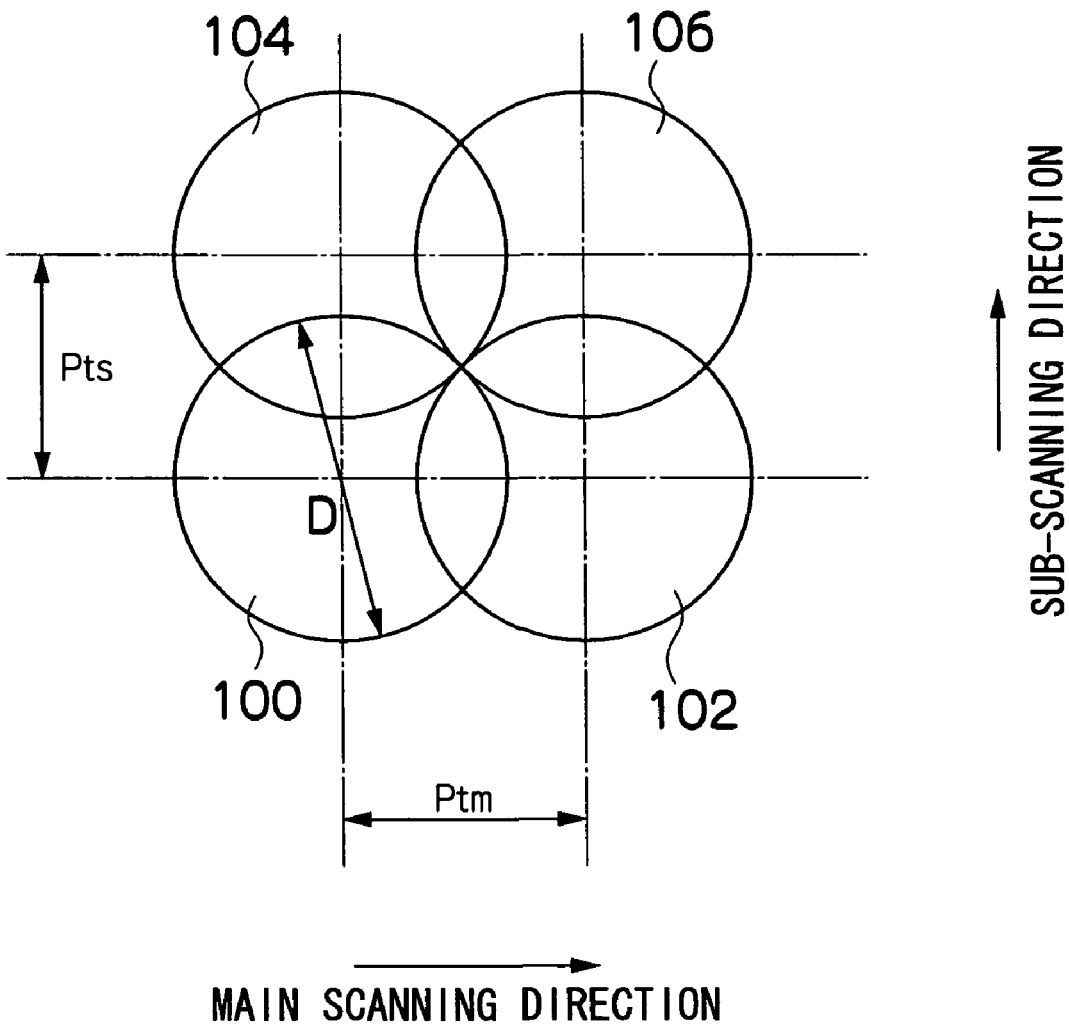
FIG. 8 is a diagram illustrating dots formed by ah inkjet recording apparatus relating to the present embodiment.

FIG. 8 shows dots 100, 102, 104 and 106 formed by ink droplets ejected from the print head 50. The dot 100 is formed so as to overlap partially with the dot 102, which is adjacent in the main scanning direction, and it is also formed so as to overlap partially with the dot 104, which is adjacent in the sub-scanning direction. Furthermore, the dot 100 is also formed so as not to overlap with the dot 106 which is adjacent in the diagonal direction, and hence there is no overlap between the dot 100 and the dot 106.

In other words, taking the dot pitch in the main scanning direction to be Ptm, the dot pitch in the sub-scanning direction to be Pts (where Ptm=Pts=Pt), and the diameter of the dot formed (hereafter, called the "dot size") to be D, the dots 100, 102, 104 and 106 shown in FIG. 8 have the relationship indicated in the following equation (2):

$$D=Pt\times 2^{1/2}. \tag{2}$$

Figure 9:
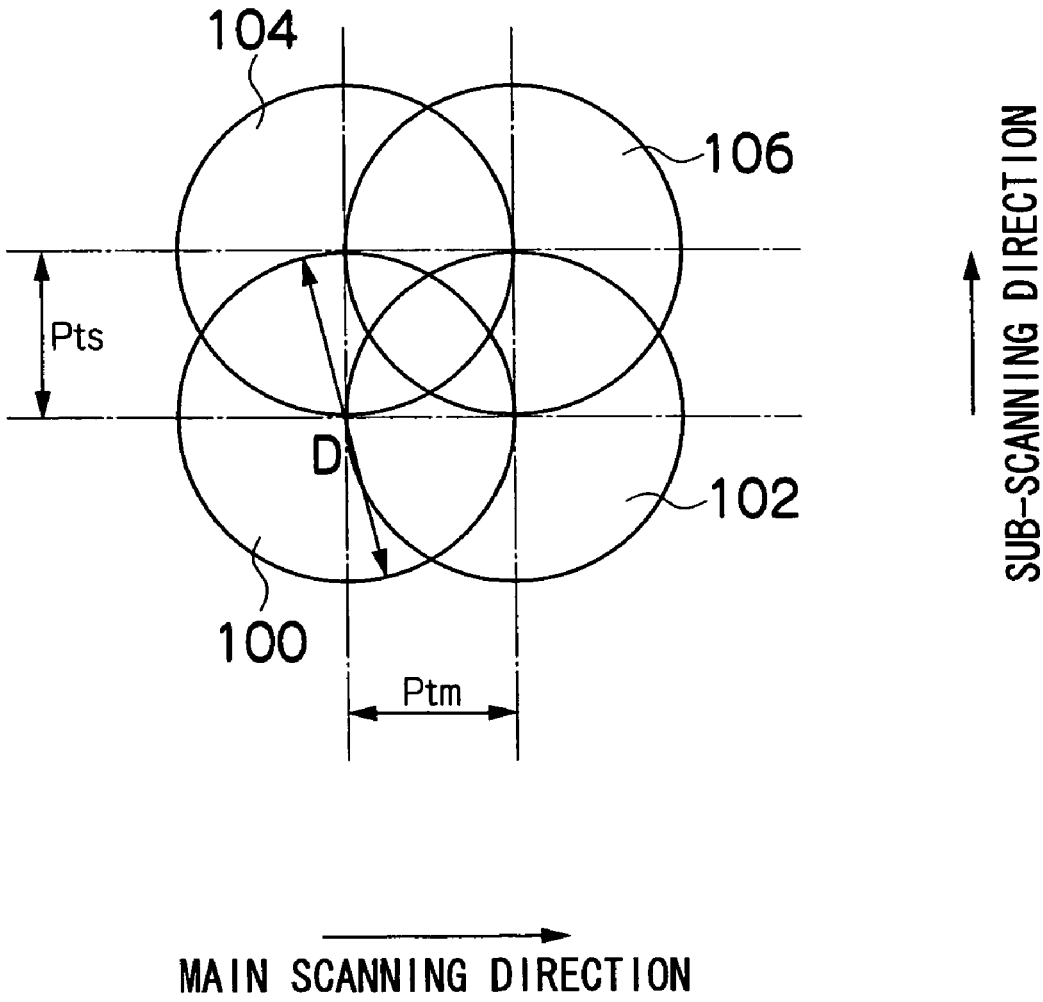
FIG. 9 is a diagram illustrating a further mode of the dots shown in FIG. 8.

On the other hand, in the example shown in FIG. 9, the dot 100 is formed so that it also overlaps partially with the dot 106 which is adjacent in the diagonal direction. In this case, the dots 100, 102, 104 and 106 have the relationship indicated in the following equation (3):

$$D=Pt\times 2. \tag{3}$$

In this inkjet recording apparatus 10, when forming a row of dots in the sub-scanning direction (namely, a row of dots formed by ink droplets ejected from the same nozzle), droplet ejection control is implemented in such a manner that, of the droplets ejected consecutively in the sub-scanning direction, the direction of flight of the ink droplet in either the preceding droplet ejection operation and/or the subsequent droplet ejection operation is deflected in the sub-scanning direction, thereby shifting the landing position of the dot by a prescribed amount in the sub-scanning direction. Furthermore, the amount of this shift is determined so as to be an integral factor of the dot pitch Pts in the sub-scanning direction. The change, y, in the landing position in the sub-scanning direction (namely, the amount of change from the original landing position) is expressed by the following equation (4), using at least two types of desired integers I:

$$y=I\times Pt. \quad (4)$$

A unit of length (mm, μm, or the like) is used with the change, y, in the landing position in the sub-scanning direction.

More specifically, when droplets are ejected continuously from the same nozzle, droplet ejection control is implemented in such a manner that ink droplets forming mutually adjacent dots are not ejected in consecutive fashion, but rather, when ejecting droplets continuously in the sub-scanning direction, the direction of flight of the ink droplets is deflected so as to shift the landing position through I dots in the sub-scanning direction, from the original landing position directly below the nozzle.

In other words, the integer I indicates the amount of shift in the sub-scanning direction and represents the number of dots by which the landing position is shifted in the sub-scanning direction.

Figure 10:
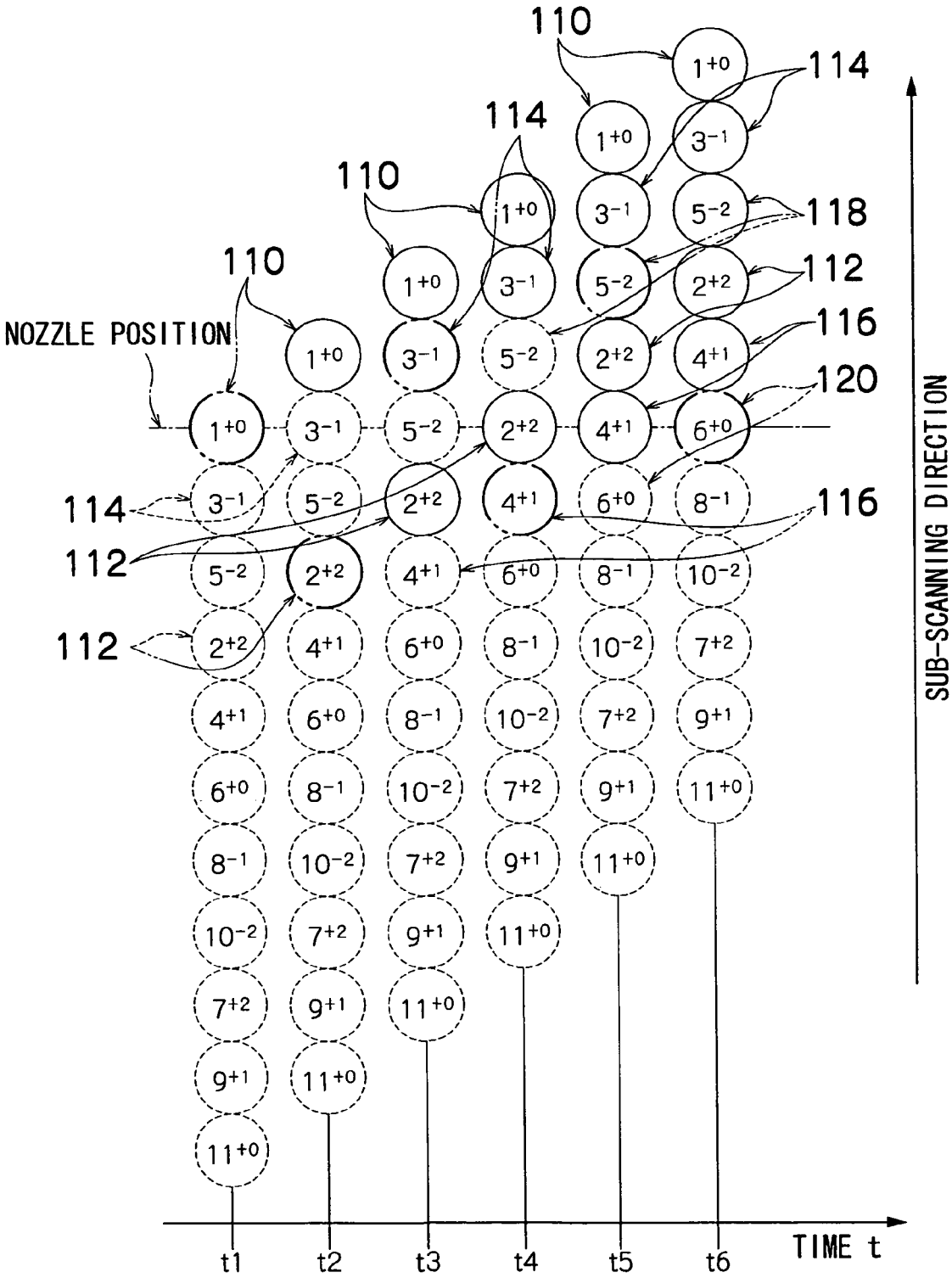
FIG. 10 is a diagram illustrating droplet ejection control in an inkjet recording apparatus relating to the present embodiment.

FIG. 10 shows rows of dots in the sub-scanning direction formed by the inkjet recording apparatus 10, the dots being arranged in a time series sequence. In FIG. 10, the vertical axis indicates the sub-scanning direction, and the horizontal axis indicates the droplet ejection timing (time) as a time sequence from left to right.

The dots indicated by the solid lines are dots that have already been formed, and the dots indicated by the dashed lines are dots that are to be formed at subsequent droplet ejection timings (dot that have not yet been formed at the current timing). Furthermore, the dots indicated by the alternate long and two short dashes lines are dots that are formed by droplet ejection at the current timing.

The numerals inside the dots indicate the droplet ejection sequence, and in the suffixes to these numerals, the symbol indicates the shift direction and the number indicates the amount of shift I in the sub-scanning direction. A shift direction of + indicates that the direction of flight of the ink droplet is deflected toward the upstream side in the conveyance direction of the recording paper (sub-scanning direction), and a shift direction of – indicates that the direction of flight of the ink droplet is deflected in the downstream direction of the conveyance direction of the recording paper. The number indicating the amount of shift I in the sub-scanning direction is stated in terms of a number of dots.

For example, the dot 110 ejected at timing t1 is marked with $1^{+0}$. This indicates that the dot is ejected at timing t1, and that the amount of shift is zero (in other words, it is not shifted). Similarly, the dot 112 ejected at timing t2 is marked $2^{+2}$, which means that the dot is ejected at timing t2, and the direction of flight of the ink is deflected by an amount corresponding to two dots toward the upstream side of the conveyance direction of the recording paper.

Here, in describing the direction of flight of the ink droplet, the upstream side of the conveyance direction of the recording paper is simply called "positive direction", and the downstream side is simply called "negative direction".

According to FIG. 10, at timing t1, droplets are ejected to form the dots 110 whose direction of flight is not deflected. At the next ejection timing t2, the dots 112 are formed at positions shifted by two dots in the positive direction. Moreover, at timing t3, the dots 114 are formed at positions shifted by one dot in the negative direction. At timing t4, the dots 116 are formed at positions shifted by one dot in the positive direction. At timing t5, the dots 118 are formed at positions shifted by two dots in the negative direction. At timing t6, the dots 120 having a shift of zero are formed, similarly to timing t1.

In the example shown in FIG. 10, five types of integers, namely 0, +1, −1, +2 and −2 are used as the shift amount I in the sub-scanning direction, but it is sufficient to use three or more different integers for the shift amount I in the sub-scanning direction. If two types of integers are used for the shift amount I in the sub-scanning direction, then droplet ejection is implemented in such a manner that the distance between dots formed by consecutively ejected droplets is equivalent to two dots or more (in other words, $I \geqq 2$).

By controlling the ejection of ink droplets in this way, ink droplets forming dots that are adjacent to other dots are first ejected at timing t3. In other words, the ink forming the dots 114 which are adjacent to the dots 110 formed by the ink ejected at the timing t1 is ejected at the timing t3, which is two ejection cycles after the timing t1. Therefore, the ink droplets of the dots 110 will have proceeded to permeate or become fixed during two cycles, and hence no deposition interference will occur when the ink droplets forming dots 114 are ejected.

Similarly, the ink droplets forming the dots 116 which are adjacent to the dots 112 formed by the ink droplets ejected at the timing t2 are ejected at the timing t4, and since the ink droplets forming the dots 112 proceed to permeate and become fixed during two cycles, no deposition interference occurs when ink droplets are ejected at the timing t4 to form the dots 116 which are adjacent in the sub-scanning direction.

In this way, even in the case of single-pass printing in which a uniform droplet ejection cycle and uniform conveyance speed are maintained, without changing the relative positions of the print head 50 and the recording paper 16, it is possible to ensure a prescribed printing speed without the occurrence of deposition interference. If the droplet ejection control is changed in relation to the droplet deposition cycle (ejection cycle), or the conveyance speed of the recording paper 16, or the like, then the conditions for deflecting the direction of flight of the droplets are also changed accordingly.

Figure 11:
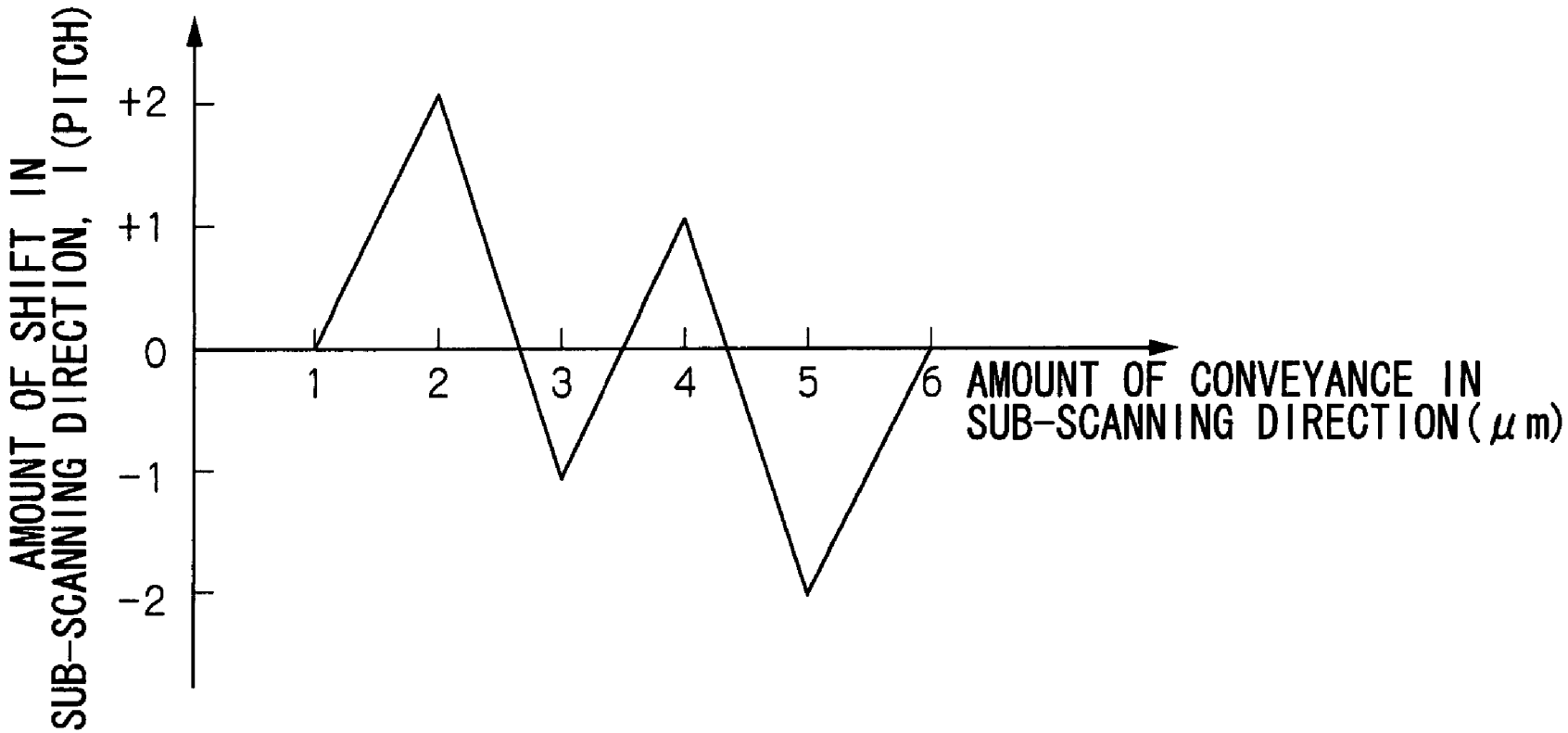
FIG. 11 is a diagram showing a pattern of direction of flight deflection control in the droplet ejection control illustrated in FIG. 10.

FIG. 11 shows a direction of flight control pattern. In FIG. 11, the vertical axis indicates the amount of shift I in the sub-scanning direction, and the horizontal axis indicates the conveyance amount in the sub-scanning direction (unit: μm). In the flight deflection control pattern shown in FIG. 11, the inkjet recording apparatus 10 ejects droplets with a prescribed amount of shift, at respective droplet ejection timings, every 1 μm in the sub-scanning direction. A desired image is formed on the recording paper 16 by repeating this flight deflection control pattern. Here, for the sake of convenience, it is supposed that Ptm=Pts=Pt=1 μm, but at a resolution of 1200 dpi, for instance, Pt is approximately 10 μm.

For the method of deflecting the direction of flight of the ink droplets in the sub-scanning direction, it is possible to use the method described in Japanese Patent Application Publication No. 2000-177115, in which the direction of flight of ink droplets is deflected by imparting electrostatic charge to the ink (or using electrostatically charged ink) and causing an electrical field to act on the space through which the ink droplets travel. Alternatively, it is possible to use the method described in Japanese Patent Application Publication No. 2000-185403, in which a plurality of bubble-generating heaters are provided in the sub-scanning direction at each nozzle, and the direction of flight of the ink is deflected by switching these heaters on and off, selectively. Of course, it is also possible to adopt a method other than the above for deflecting the direction of flight of the ink.

Next, a modification example of the droplet ejection control is described with reference to FIG. 12.

Figure 12:
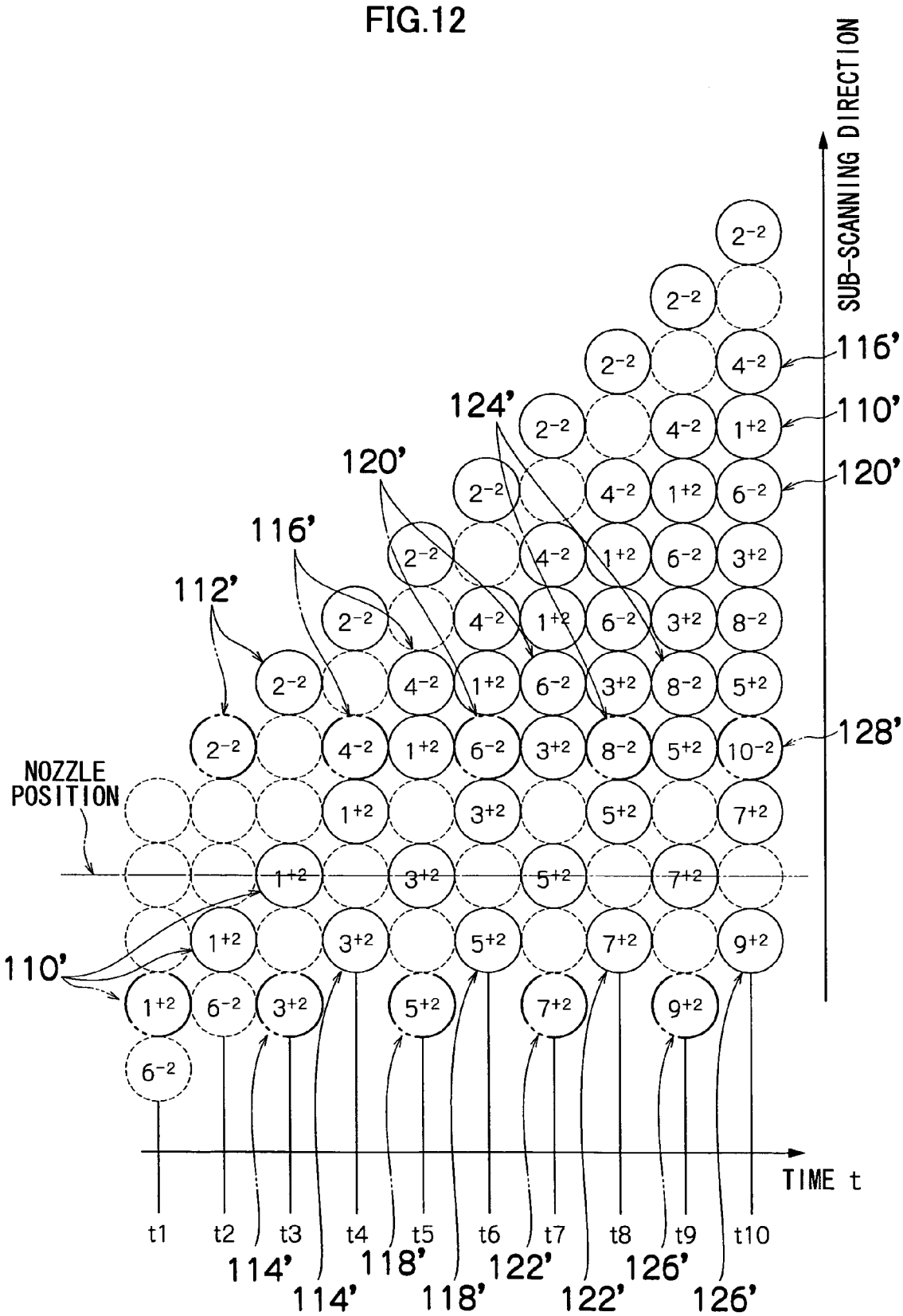
FIG. 12 is a diagram showing a further mode of the droplet ejection control shown in FIG. 10.

FIG. 12 shows a modification example of the droplet ejection control shown in FIG. 10. In FIG. 12, items which are the same as or similar to those in FIG. 10 are labeled with the same reference numerals and description thereof is omitted here.

In FIG. 12, −2 and 2 are used as the integers I. In other words, taking the one type of integer to be k, the relationship between the amount of shift I in the sub-scanning direction, and the integer k, is expressed by the following equation (5):

$$I=\pm k, \tag{5}$$

where k is a positive integer of 2 or above (in other words, a natural number of two or above).

In the modification example shown in FIG. 12, the dots 110' deposited at timing t1 are dots that are formed at positions shifted by two dots in the positive direction. At timing t2, dots 112' are formed at positions shifted by two dots in the negative direction. Furthermore, at timing t3 and timing t4, dots 114' and 116' are formed at positions shifted by two dots in the positive direction and the negative direction, respectively. From timing t5 onwards, the direction of flight of the ink droplets is controlled in such a manner that dots 118', 120', 122', 124', 126' and 128' are formed at positions shifted alternately by two dots in the positive direction and by two dots in the negative direction.

In the modification example shown in FIG. 12, droplets are first ejected to form dots adjacent to other dots in the sub-scanning direction at timing t4. More specifically, the timing at which ink is ejected to form dots 116', which are adjacent to dots 110' formed by ink droplets ejected at timing t1, is timing t4. Therefore, the ink droplets forming the dots 110' will have proceeded to permeate and become fixed during three cycles, and hence no deposition interference will occur when the ink droplets forming the dots 116' are ejected at timing t4.

In the example shown in FIG. 12, since ink droplets are ejected to form dots adjacent to other dots after time equivalent to three cycles has passed, an extra margin of one cycle is provided in comparison to the example shown in FIG. 10, and therefore the interval between droplet ejection timings can be reduced.

Figure 13:
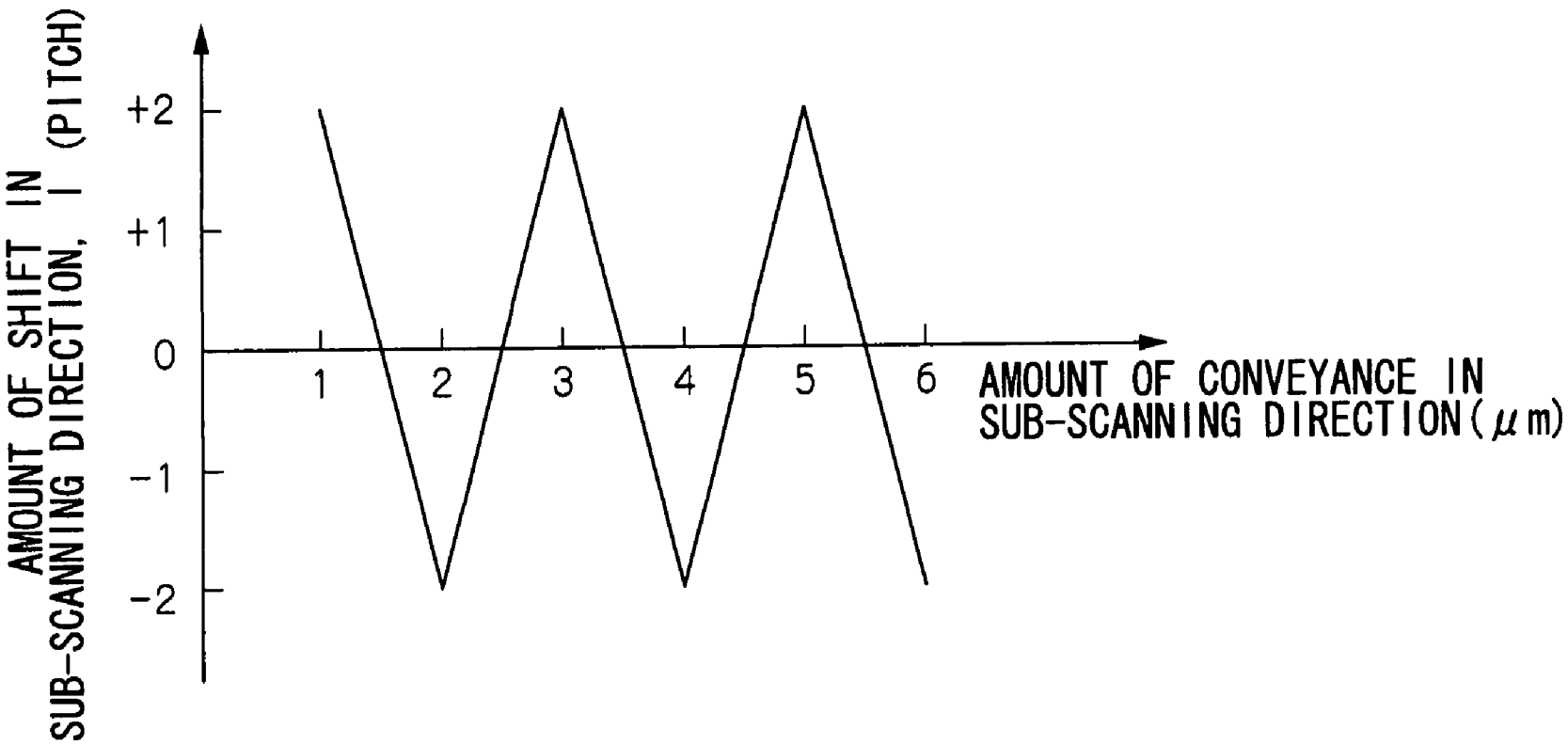
FIG. 13 is a diagram showing a pattern of direction of flight deflection control in the droplet ejection control shown in FIG. 12.

FIG. 13 shows a flight deflection control pattern for forming the dots shown in FIG. 12. A desired image is formed on the recording paper 16 by repeating the flight deflection control pattern shown in FIG. 13.

FIG. 10 and FIG. 12 do not show the mutually adjacent dots to be overlapping, in order that the numerals and suffixes can be depicted inside the dots, but when actually formed, the dots overlap with each other as illustrated in FIG. 8 and FIG. 9.

Figure 14:
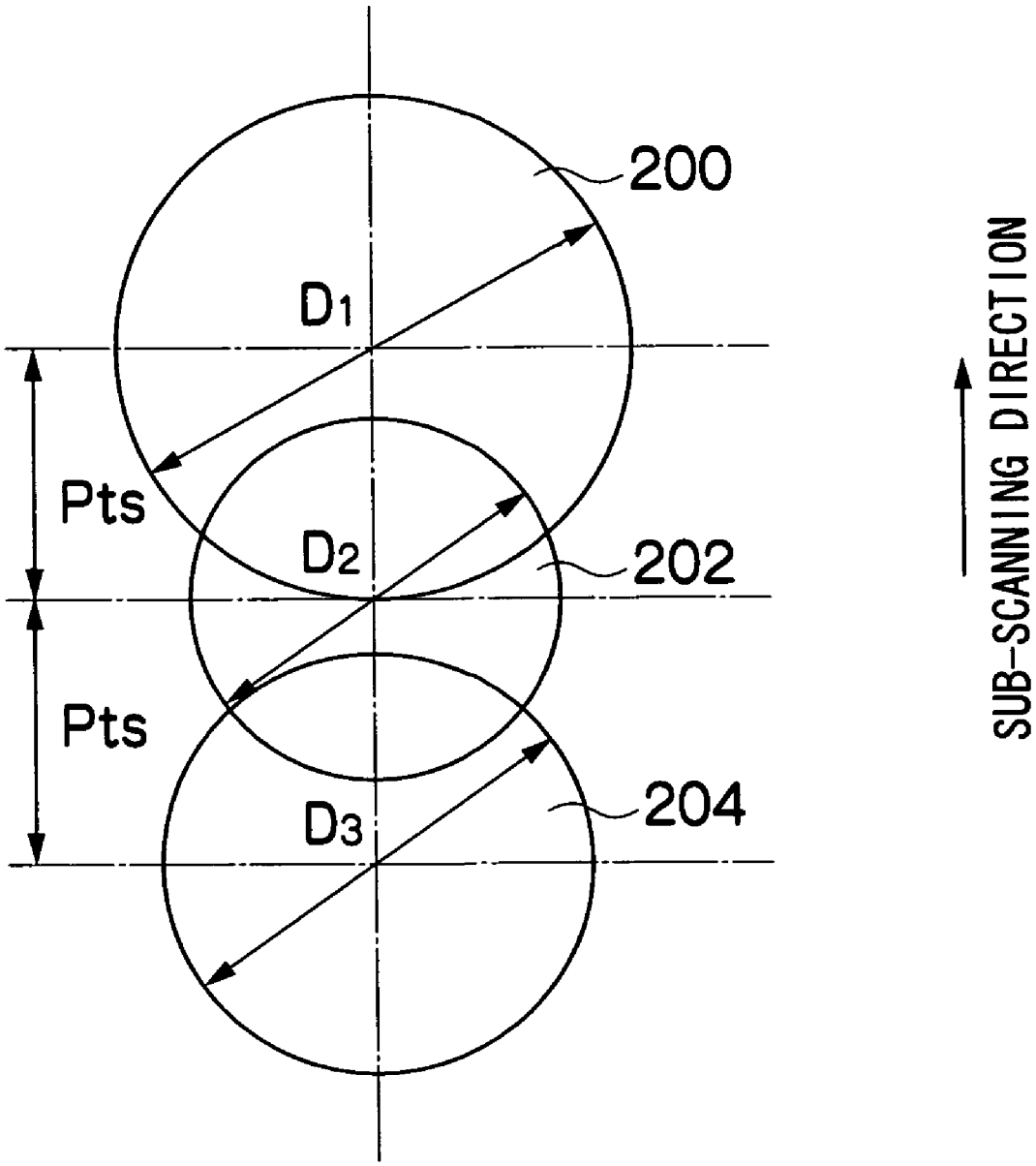
FIG. 14 is a diagram illustrating the relationship between dot pitch and dot diameter in the droplet ejection control of an inkjet recording apparatus relating to an embodiment of the present invention.

FIG. 14 shows an example in which dots of different dot size are formed consecutively in the main scanning direction. The dot size of dot 200 is D1, the dot size of dot 202 is D2 and the dot size of dot 204 is D3. In order to form dots of this kind, if a droplet is ejected to form dot 204 consecutively after ejecting a droplet to form dot 200, then the following inequality (6) must be satisfied if the dot 200 and the dot 204 are not to overlap:

$$D1+D3<2\times\mathrm{Pts}. \tag{6}$$

The dot sizes D1 and D3 and the dot pitch Pts in the sub-scanning direction should be set in such a manner that the above-described equation (5) is satisfied.

More specifically, provided that the conditions for preventing overlapping between alternate dots are satisfied, then even if droplets are ejected to form dot 200 and dot 204 consecutively, there will be no overlap between these dots. Therefore, in the case of FIG. 10, for example, it is possible to eject droplets to form dots 112 and dots 114 in a consecutive fashion.

This example related to droplet ejection control for preventing deposition interference in the sub-scanning direction; however, as shown in FIG. 8 and FIG. 9, dots that are mutually adjacent in the main scanning direction are also formed in an overlapping fashion, and it is therefore also desirable to control droplet ejection in such a manner that ink droplets forming dots that are mutually adjacent in the main scanning direction do not land on the recording paper 16 simultaneously.

As shown in FIG. 5, in a print head 50 having nozzle rows arranged in a matrix configuration, then nozzles 51-11 and 51-12 are nozzles which form dots that are mutually adjacent in the main scanning direction.

Nozzles 51-11 and 51-12 are positioned a distance of $d\times\sin\theta$ apart in the main scanning direction, and the ejection timings of the ink droplet ejected from nozzle 51-11 and the ink droplet ejected from the nozzle 51-12 are staggered, thereby creating a difference between the landing times of these ink droplets.

More specifically, in order to prevent ink droplets that form adjacent dots in the main scanning direction from landing simultaneously, the nozzles which eject ink droplets to form dots that are mutually adjacent in the main scanning direction are positioned at a prescribed distance apart in the sub-scanning direction. This creates a difference between the landing times of the ink droplets forming adjacent dots in the main scanning direction.

The difference between landing times is determined on the basis of the conveyance speed of the recording paper 16, the flight velocity of the ink droplets, the distance between nozzles (the amount of shift), and the ink permeation time or fixing time, which is derived from the type of recording paper 16 and the type of ink. More specifically, a desirable difference between the landing times of ink droplets forming dots that are adjacent in the main scanning direction is achieved by controlling the conveyance speed of the recording paper 16 in accordance with the permeation time of the ink. It is possible to formulate a data table recording the relationships between the permeation times for each type of recording paper 16 and each type of ink, the conveyance speed of the recording paper 16, and the flight velocity of the ink droplets, and this data table may be recorded in a memory device (for example, a memory provided inside the image memory 74 in FIG. 7 or the MPU of the system controller, or the like).

Figure 15:
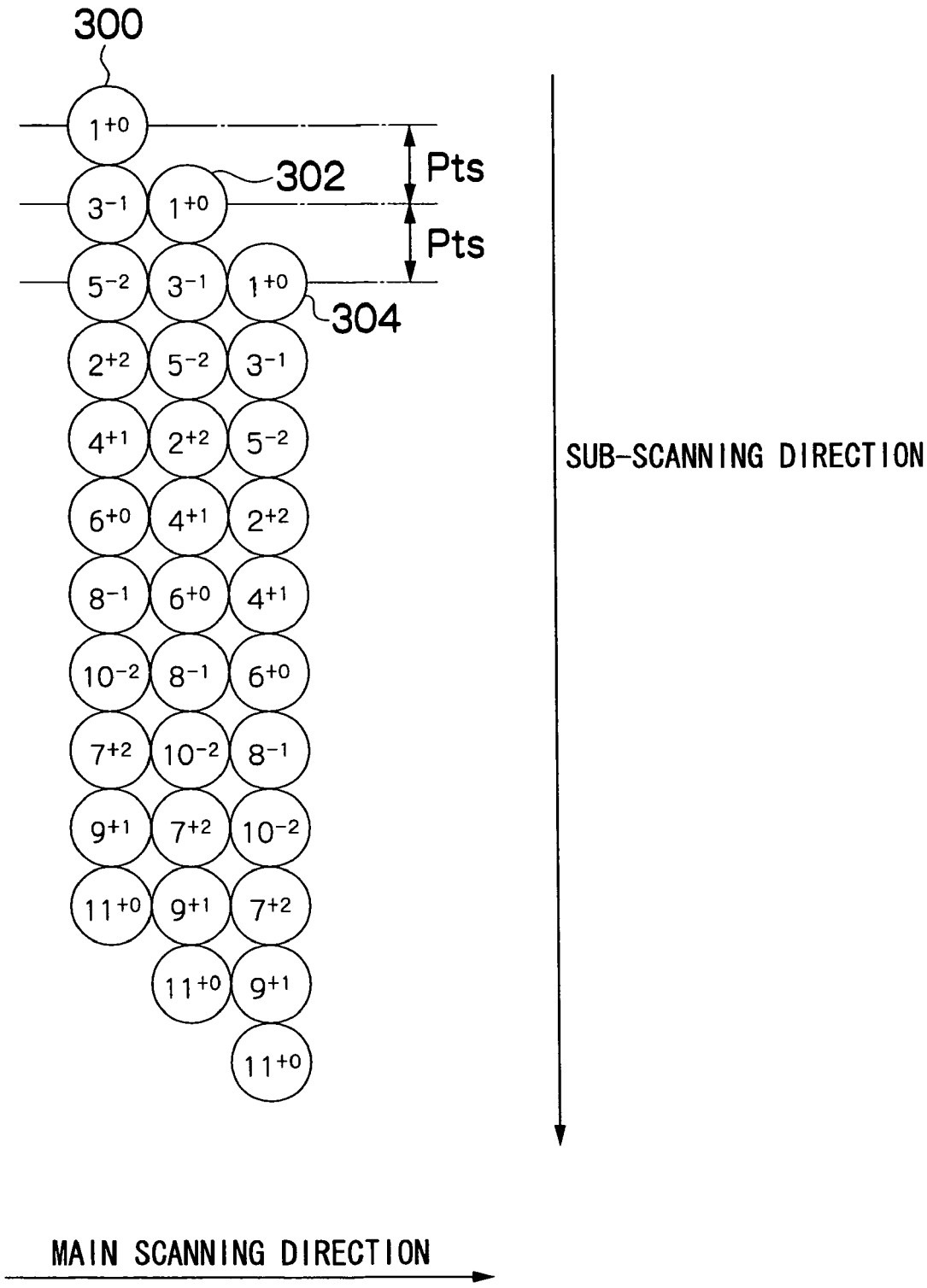
FIG. 15 is a diagram illustrating droplet ejection control in a main scanning direction, in an inkjet recording apparatus relating to the present invention.
Figure 16:
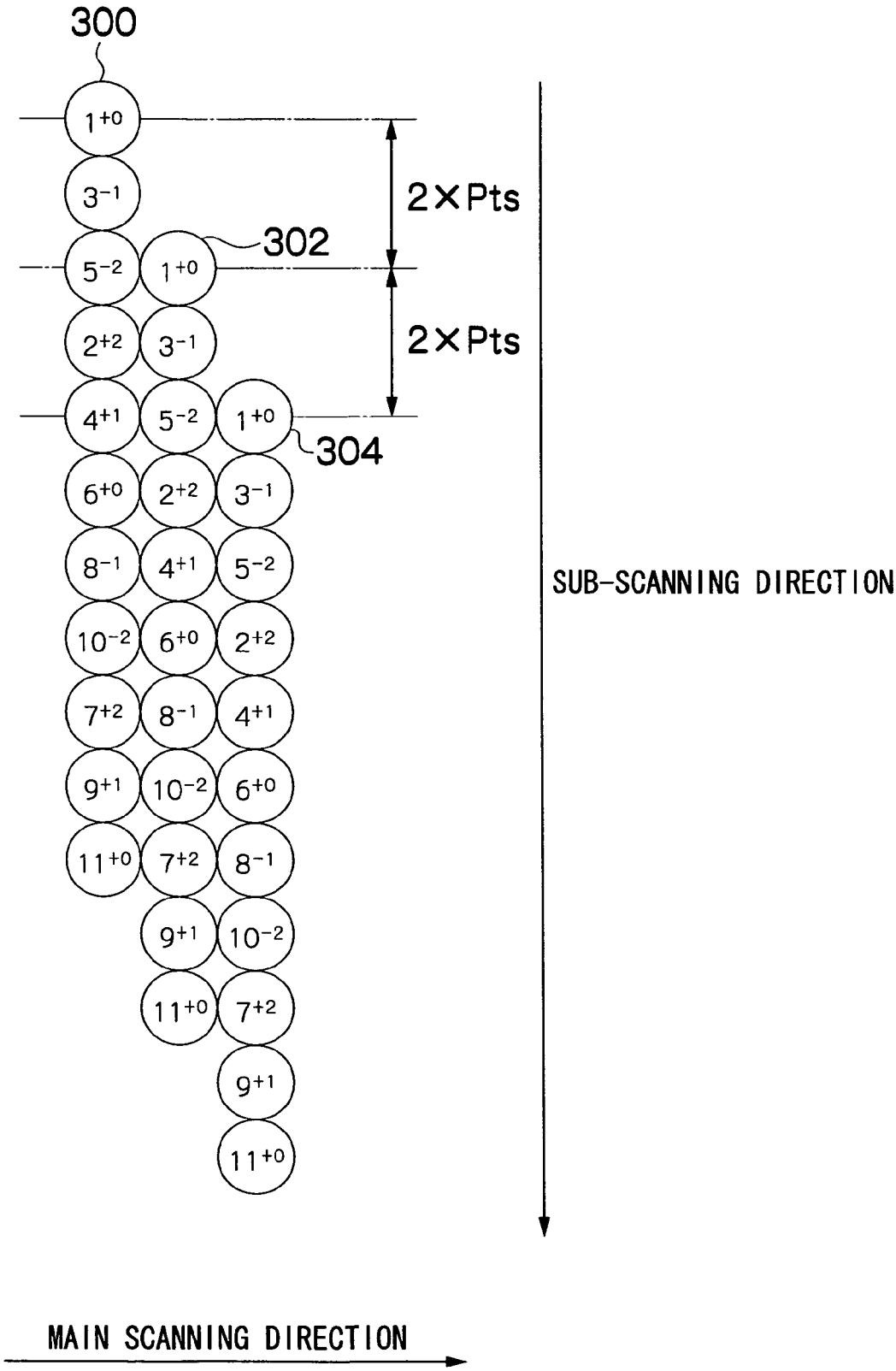
FIG. 16 is a diagram illustrating a further mode of the droplet ejection control in the main scanning direction illustrated in FIG. 15.

FIG. 15 shows dots formed on the recording paper 16 under conditions for forming (positioning) dots in such a manner that dots that are mutually adjacent in the main scanning direction or the sub-scanning direction overlap with each other, and dots that are mutually adjacent in a diagonal direction do not overlap with each other, as shown in FIG. 8. FIG. 16 shows dots formed on the recording paper 16 under conditions for forming (positioning) dots in such a manner that dots that are mutually adjacent in the main scanning direction, the sub-scanning direction or the diagonal direction, overlap with each other, as shown in FIG. 9.

In FIG. 15 and FIG. 16, items which are the same as or similar to those in FIG. 10 and FIG. 12 are labeled with the same reference numerals and description thereof is omitted here.

In FIG. 15, the vertical axis represents the sub-scanning direction and the horizontal axis represents the main scanning direction. Furthermore, in FIG. 15, the upper side of the sub-scanning direction indicates the upstream side and the lower side indicates the downstream side.

The dot rows shown in FIG. 15 can be formed using the droplet ejection control shown in FIG. 10 in respect of the sub-scanning direction. On the other hand, the positions of the nozzles forming adjacent dots in the main scanning direction are separated by the sub-scanning direction dot pitch, Pts, in the sub-scanning direction. Therefore, dots that are adjacent in the main scanning direction are formed by droplets ejected after a delay equivalent to one ejection cycle in the sub-scanning direction. Dots 300, 302 and 304 are not depicted as being adjacent in the main scanning direction in FIG. 15, but in reality, these dots are formed so as to be mutually adjacent in the main scanning direction.

In FIG. 15, dots having the same number indicated inside the dot are dots which are mutually adjacent in the main scanning direction.

In FIG. 16, the positions of the nozzles forming dots that are adjacent in the main scanning direction are separated in the sub-scanning direction by a distance equal to twice the sub-scanning direction dot pitch (2×Pts).

The present embodiment related to a mode where the landing positions of the ink droplets are shifted alternately in the positive direction and the negative direction, but it is also possible to adopt a mode where the positive direction and the negative direction are switched every certain number of cycles.

Printing Speed

Next, the relationship between printing speed and the droplet ejection control relating to the present invention will be described.

FIG. 16 shows a dot row formed when printing onto postcard-size recording paper 16 at a rate of 35 sheets per minute.

In the example shown in FIG. 16, taking the conveyance speed of the recording paper 16 to be 1.67 mm/sec and the dot density to be 600 dpi, the dot pitch Pt will be 42.2 μm and the droplet ejection cycle will be 25.3 msec.

If a general ink permeation time of 20 msec can be used for the permeation time of the ink in the medium (recording paper 16), then it is possible to print without deposition interference at the conveyance speed of 1.67 mm/sec, even if the droplet ejection control relating to the present invention is not applied.

However, if it is sought to increase the conveyance speed to approximately 10 mm/sec (roughly six times that of the example described above), in order to increase productivity, then the droplet ejection cycle becomes around 4.2 msec. Therefore, if the droplet ejection control relating to the present invention is not applied, there is not sufficient time for the ink to permeate, and hence deposition interference occurs, the dot shapes are disrupted, and the desired image cannot be formed.

Figure 17:
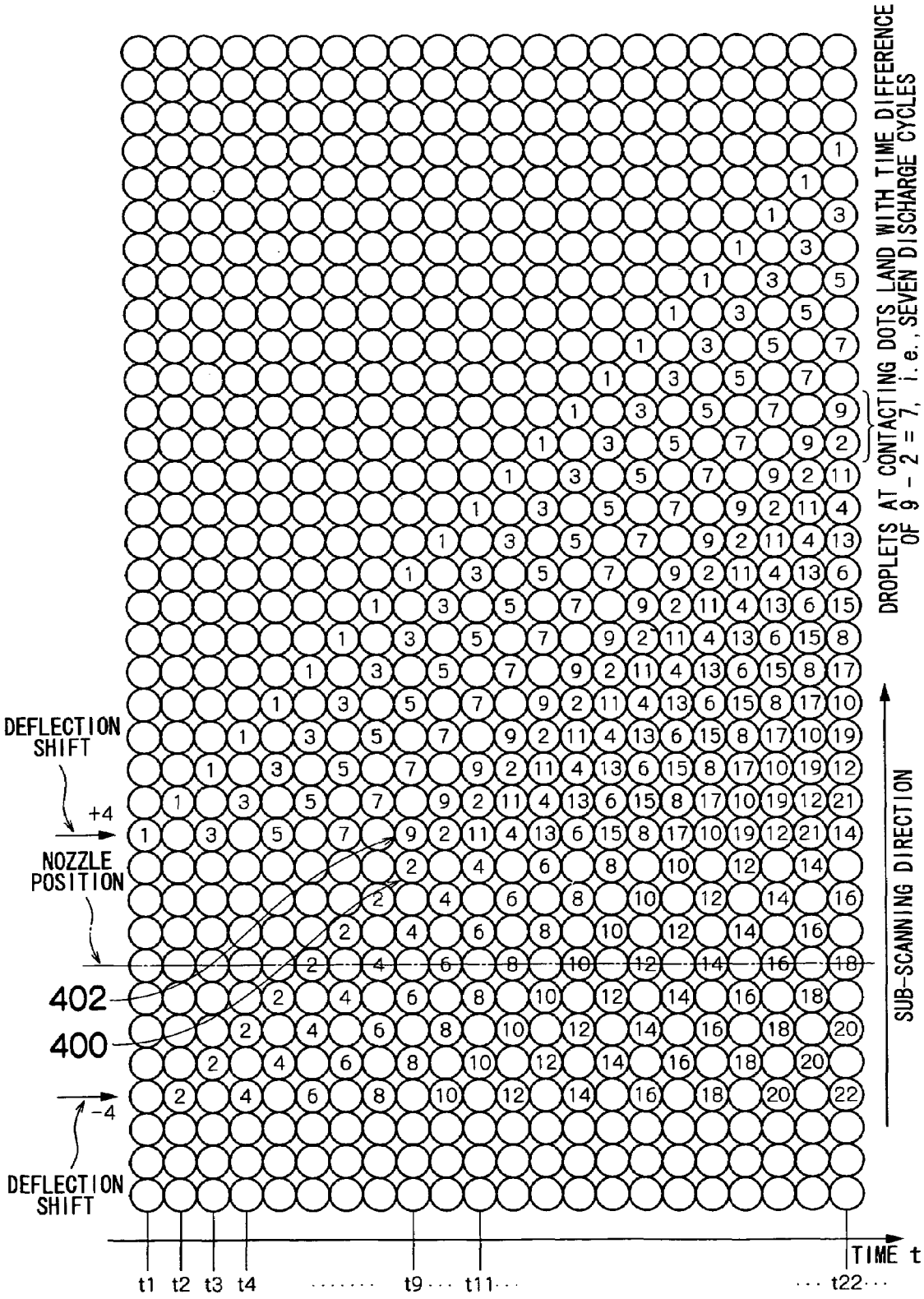
FIG. 17 is a diagram showing dots formed by applying the droplet ejection control for an inkjet recording apparatus relating to the present embodiment.

Therefore, by applying the droplet ejection control relating to the present invention, as shown in FIG. 17, after the dot formed directly below the nozzle, dots are formed at the four adjacent dot positions by shifting the direction of flight and deflecting the flight of the ink droplets alternately toward the upstream and downstream side in the conveyance direction of the recording paper. Therefore, the difference between the landing times of the ink droplets forming the adjacent dots is approximately 25.3 msec, which is equivalent to 7 ejection cycles. Since this is greater than the permeation time of 20 msec, deposition interference can be prevented.

FIG. 17 shows dots formed by using +4 and −4 as the shift I (deflection shift) in the sub-scanning direction. In FIG. 17, similarly to FIG. 10 and FIG. 12, the horizontal axis indicates time and the vertical axis indicates the sub-scanning direction (where the upstream side is in the lower direction and the downstream side is in the upper direction). Furthermore, the numerals shown inside the dots indicates the droplet ejection timing.

According to FIG. 17, at timing t9, an ink droplets is ejected to form dot 402 that is adjacent in the sub-scanning direction to the dot 400 formed by ink ejected at timing t2. Therefore, there is a difference between the landing times equivalent to 7 cycles (approximately 25.3 msec), and since this is greater than the standard permeation time of the ink, which is 20 msec, then dot 402 is ejected after the ink droplet forming dots 400 has permeated into the medium.

Moreover, at in droplet ejection from timing t11 onwards, ink droplets are deposited to form adjacent dots other than dot 400 and dot 402, but since there is a difference of at least 7 cycles between the landing times in any of these cases, then deposition interference does not occur and a desired image can be obtained.

In general, the time T until an adjacent dot lands on the medium is expressed by the following equation (7), using the shift I (±k) in the sub-scanning direction and the droplet ejection cycle Tf:

$$T=Tf\times(2k-1). \tag{7}$$

The value of k shown in the equation (7) should be set in such a manner that the time T is greater than the permeation time $T_0$ (namely, $T \geqq T_0$).

In other words, the shift I in the sub-scanning direction should be set in such a manner that the equation (7) is satisfied. This is expressed in the following inequality (8):

$$k \geqq \{(T_0/Tf)+1\}/2. \tag{8}$$

The inequality (8) is derived from the following inequality (9) by conversion with respect to I:

$$Tf\times(2k-1) \geqq T_0. \tag{9}$$

Amount of Deflection of Flight

Next, the amount of deflection of the flight (the flight angle) is described.

As shown in FIGS. 3A to 4B, the inkjet recording apparatus 10 comprises a flight direction deflecting device which deflects the direction of flight of the ink.

As shown in FIG. 4B, the distance z (clearance) between the nozzle surface of the print head 50 and the recording paper 16 is approximately 2 mm. The flight deflection angle θ of the ink droplet is determined from the shift in the sub-scanning direction, y, and the clearance z between the print head 50 and the recording paper 16, on the basis of the following equation (10):

$$\theta=\arctan(y/z). \tag{10}$$

The equation (10) is derived from the equation (1) by conversion with respect to θ.

More specifically, if the dot density is 600 dpi, then the dot pitch will be 42.2 μm, and in the case of a shift in the sub-scanning direction corresponding to four dot spaces, as shown in FIG. 17, the shift y in the sub-scanning direction will be 0.08 and the flight deflection angle θ will be 4.82° (degrees).

Furthermore, if the shift in the sub-scanning direction is taken to be 11 dot spaces, then the flight deflection angle θ will be 13.1°.

In the inkjet recording apparatus 10 having the composition described above, when forming a dot row in the sub-scanning direction in such a manner that adjacent dots are overlapping at least in the sub-scanning direction, if droplets are ejected continuously, then the direction of flight of at least one of either an ink droplet deposited by a preceding droplet ejection operation or an ink droplet deposited by a subsequent droplet ejection operation is deflected in the sub-scanning direction, and hence adjacent dots are not formed by mutually consecutive droplet ejection operations and deposition interference does not occur.

The amount of deflection used when deflecting the direction of flight of an ink droplet in the sub-scanning direction is set to be an integral factor (factor I) of the dot pitch in the sub-scanning direction. The direction of deflection may be a positive direction or a negative direction. Moreover, in order to simplify the droplet ejection control sequence, it is also possible to set the amount of deflection to ±k times the dot pitch in the main scanning direction (where k is a natural number of 2 or above, in other words, I=±k).

The time at which the adjacent dots land on the medium is expressed as $Tf\times(2k-1)$, from the shift I in the sub-scanning direction and the droplet ejection cycle Tf in the sub-scanning direction. Taking the permeation time of the ink to be $T_0$, the composition is designed in such a manner that I satisfies the relationship $Tf\times(2k-1)\geqq T_0$. Therefore, it is possible to set a flight direction deflection pattern for preventing deposition interference, with respect to various parameter conditions, such as the dot density, the conveyance speed of the recording paper 16, the ink permeation time, and the like.

Furthermore, if dots are formed so as to overlap in the main scanning direction, as well as the sub-scanning direction, by using a matrix head in which nozzles are two-dimensionally arranged, then a composition is adopted in which the nozzles which eject ink droplets to form dots that are mutually adjacent in the main scanning direction are positioned at a prescribed distance apart in the sub-scanning direction. If a composition of this kind is adopted, then it is possible to create a differential between the landing times of ink droplets that form adjacent dots in the main scanning direction, and hence a two-dimensional nozzle arrangement pattern which is suitable for high-density droplet ejection can be utilized effectively.

The present embodiment was described with respect to a full line print head comprising nozzle rows of a length corresponding to the recordable width of the recording paper, but the scope of the present invention is not limited to a full line print head of this kind, and it may also be applied to a shuttle type print head which has nozzle rows of a length shorter than the recordable width of the recording paper and moves reciprocally in the breadthways direction of the recording paper. Of these, the present invention is particularly valuable in a single-pass shuttle system which completes image formation onto the region scanned by the print head, by means of just one shuttle scanning action.

On the other hand, by reducing the intermittent feed distance of the recording paper to a distance smaller than the print length of the print head in the sub-scanning direction, it is possible to obtain the beneficial effects of the present invention in a system which prints onto the same image region by means of a plurality of scans.

A method for printing onto recording paper 16 by means of a single-pass shuttle system is now described with reference to FIG. 18.

Figure 18:
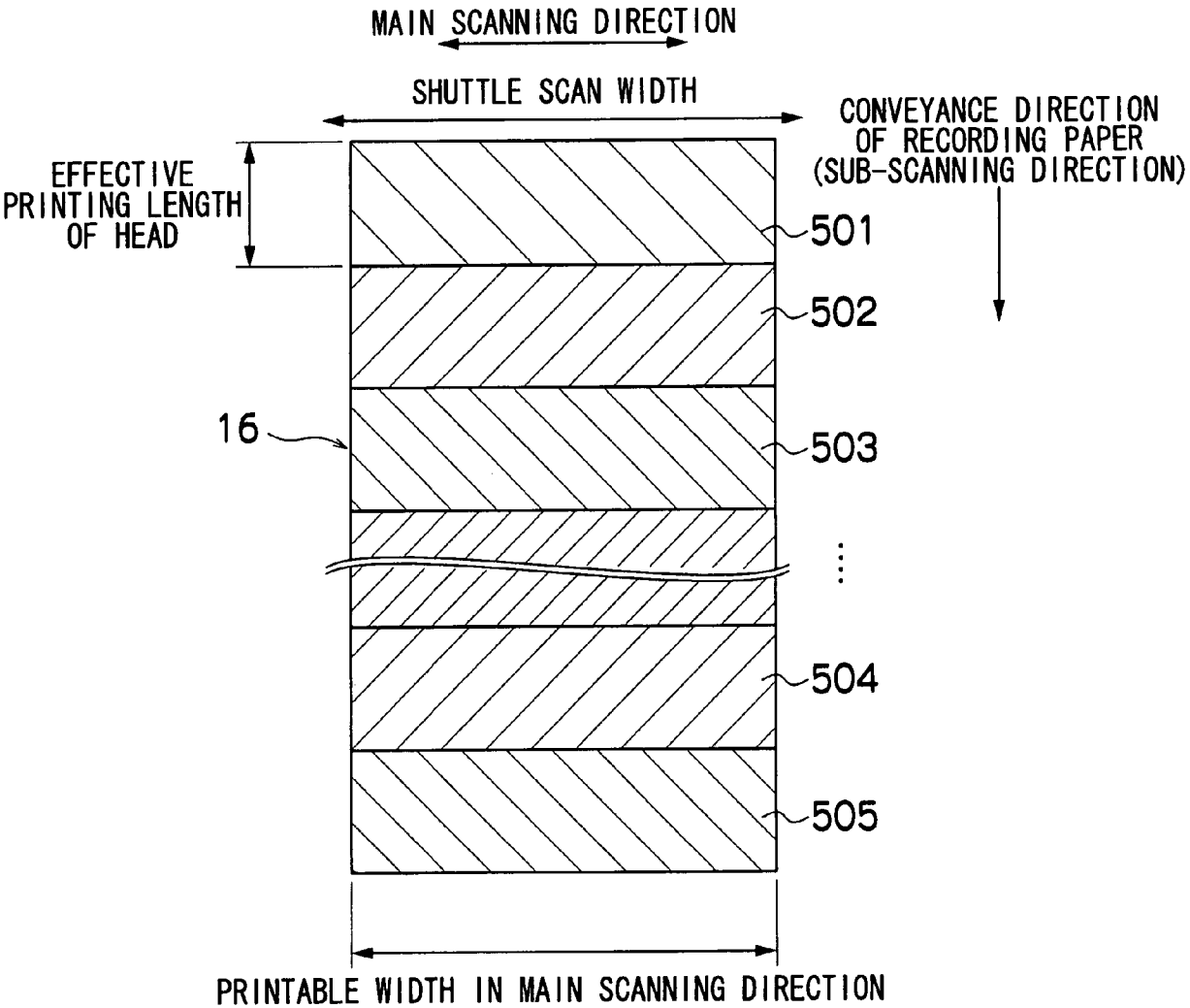
FIG. 18 is a diagram illustrating single-pass printing by a shuttle type head.

FIG. 18 shows a print region of the recording paper 16 which is printed by means of a shuttle type print head. As shown in FIG. 18, the shuttle scanning width of the print head (the scanning width in the main scanning direction) is set to be greater than the printable width in the main scanning direction.

In the first shuttle scan, the print region 501 is printed. The length of the print region 501 in the sub-scanning direction is approximately the same as the effective printing length of the print head.

In the second shuttle scan, the print region 502 is printed, and then the print region 503 is printed. When the print head has performed one scan in the main scanning direction in this way, the print head and the recording paper 16 are moved relative to each other in the sub-scanning direction, and printing is performed in a sequential fashion.

When the print region 504 is printed in the (i−1)-th shuttle scan, and print region 505 is printed in the i-th shuttle scan, then printing will have been performed on the whole surface of the recording paper 16 and a desired image will have been formed on the recording paper 16.

It should be noted that, in the movement to the first main scan, printing onto the corresponding print region may be performed in the main scanning direction by moving the print head in one direction, or by moving the print head reciprocally, back and forth.

More specifically, it is possible to control printing in such a manner that when printing the print region 501, the pint head is moved in one direction in the main scanning direction (for example, from left to right in FIG. 18), and when printing the print region 502, the print head is moved in the other direction of the main scanning direction (namely, from right to left in FIG. 18).

In a shuttle type print head, a main scanning direction movement device is provided which causes the head and the recording paper 16 to move relative to each other in the main scanning direction. The main scanning direction movement device may move the print head with respect to the recording paper 16 or it may move the recording paper 16 with respect to a fixed print head. Furthermore, it is also possible to move both the print head and the recording paper 16.

Moreover, at the border between adjacent print regions (for example, print region 501 and print region 502), printing is controlled in such a manner that the print regions do not overlap.

In the present embodiment, an inkjet head used in an inkjet recording apparatus was described as an example of a liquid droplet ejection head, but the present invention may also be applied to an ejection head used in a liquid ejection apparatus which forms images, or three-dimensional shapes, such as circuit wiring or machining patterns, by ejecting a liquid (such as water, a chemical solution, resist, or processing liquid) onto an ejection receiving medium, such as a wafer, glass substrate, epoxy substrate, or the like.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

an ejection head having ejection holes which eject liquid droplets to land on an ejection receiving medium;

a conveyance device which causes the ejection head and the ejection receiving medium to move relative to each other in one direction, by conveying at least one of the ejection head and the ejection receiving medium in a relative conveyance direction substantially perpendicular to a breadthways direction of the ejection receiving medium;

a direction of flight deflecting device which deflects direction of flight of the liquid droplets ejected from the ejection head in a direction which includes at least a component that is substantially parallel to the relative conveyance direction; and a deflection control device which controls the direction of flight deflecting device, wherein when droplets are ejected during relative conveyance of the ejection receiving medium and a row of dots is formed in which dots that are mutually adjacent in the relative conveyance direction are at least partially overlapping with each other, the deflection control device changes landing positions of the liquid droplets by a droplet landing position change amount y which satisfies the following relationship:

$$y=Pts\times I,$$

where Pts is a pitch between dots in the row of dots in the relative conveyance direction, I is an amount of shift comprising two or more types of integers of any value, and y is the droplet landing position change amount in the relative conveyance direction, thereby causing the droplets to land while avoiding consecutive landing of mutually adjacent dots.

2. The liquid ejection apparatus as defined in claim 1, wherein the amount of shift I includes at least two types of integers whereby Δy which is the distance between centers of the landing positions of consecutively ejected ink droplets, satisfies the following relationship:

$$\Delta y\geqq 2\times Pts.$$

3. The liquid ejection apparatus as defined in claim 1, wherein the amount of shift I includes three or more types of integers.

4. The liquid ejection apparatus as defined in claim 1, wherein the amount of shift I includes two or more natural numbers, k, of one type which satisfy the following relationship:

$$I=\pm k.$$

5. The liquid ejection apparatus as defined in claim 4, wherein the direction of flight control device includes a shift amount setting device which sets the natural number k to a value whereby a droplet ejection cycle of the ejection head, Tf, and a permeation time of the liquid droplet into the ejection receiving medium, T0, satisfy the following relationship:

$$Tf\times(2k-1)\geqq T0.$$

6. The liquid ejection apparatus as defined in claim 1, further comprising a droplet ejection control device which, taking D1 and D2 to be diameters of two dots which share an adjacent dot in the relative conveyance direction, in a row of dots formed in the relative conveyance direction, and taking Pts to be a pitch between dots in the relative conveyance direction, sets at least one of the dot diameter D1, the dot diameter D2, and the pitch Pts between dots in the relative conveyance direction, in such a manner that the following relationship is satisfied:

$$D1+D2\leqq 2\times \mathrm{Pts}.$$

7. The liquid ejection apparatus as defined in claim 1, wherein the ejection head includes a full line type ejection head in which the ejection holes are arranged through an entire width of the ejection receiving medium.

8. The liquid ejection apparatus as defined in claim 7, wherein:

the ejection head includes a matrix head in which the ejection holes are two-dimensionally arranged; and the ejection holes which eject liquid droplets forming dots that are mutually adjacent in a direction substantially perpendicular to the relative conveyance direction are positioned at a prescribed distance apart in the relative conveyance direction.

9. An ejection control method for a liquid ejection apparatus, comprising: an ejection head having ejection holes which eject liquid droplets to land on an ejection receiving medium; a conveyance device which causes the ejection head and the ejection receiving medium to move relative to each other in one direction, by conveying at least one of the ejection head and the ejection receiving medium in a relative conveyance direction substantially perpendicular to a breadthways direction of the ejection receiving medium; and a direction of flight deflecting device which deflects a direction of flight of the liquid droplets ejected from the ejection head, the ejection control method comprising the steps of:

deflecting direction of flight of liquid droplets ejected from the ejection holes of the ejection head in a direction which includes at least a component that is substantially parallel to the relative conveyance direction, by means of the liquid droplet flight direction deflecting device, when forming a row of dots in the relative conveyance direction, and thereby changing landing positions of the liquid droplets by a droplet landing position change amount y which satisfies the following relationship:

$$y=Pts\times I,$$

where Pts is a pitch between dots in the row of dots in the relative conveyance direction, I is an amount of shift comprising two or more types of integers of any value, and y is the droplet landing position change amount in the relative conveyance direction; and causing the droplets to land while avoiding consecutive landing of mutually adjacent dots.

* * * * *